US010637152B2

(12) United States Patent
Legay et al.

(10) Patent No.: US 10,637,152 B2
(45) Date of Patent: Apr. 28, 2020

(54) POLARIZING REFLECTOR FOR MULTIPLE BEAM ANTENNAS

(71) Applicant: THALES, Courbevoie (FR)

(72) Inventors: Hervé Legay, Plaisance du Touch (FR); George Goussetis, Edinburgh (GB); Wenxing Tang, Edinburgh (GB); Daniele Bresciani, Toulouse (FR); Renaud Chiniard, Toulouse (FR); Nelson Fonseca, Noordwijk (NL)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/124,976

(22) Filed: Sep. 7, 2018

(65) Prior Publication Data

US 2020/0028273 A1 Jan. 23, 2020

(30) Foreign Application Priority Data

Sep. 11, 2017 (EP) ..... 17306169

(51) Int. Cl.
*H01Q 1/38* (2006.01)
*H01Q 15/02* (2006.01)
(Continued)

(52) U.S. Cl.
CPC ..... *H01Q 15/24* (2013.01); *H01Q 1/48* (2013.01); *H01Q 19/10* (2013.01); *H01Q 21/065* (2013.01)

(58) Field of Classification Search
CPC .... H01Q 15/0013; H01Q 15/02; H01Q 15/00; H01Q 15/0026; H01Q 15/244;
(Continued)

(56) References Cited

U.S. PATENT DOCUMENTS 5,140,338 A * 8/1992 Schmier ..... H01Q 1/42 343/700 MS
5,717,407 A * 2/1998 Hong ..... H01Q 25/001 343/700 MS
(Continued)

OTHER PUBLICATIONS

Doumanis, et al., "Dual frequency polarizing surfaces: For Ka-band applications", 2012 6th European Conference on Antennas and Propagation (EUCAP), pp. 2206-2208, Mar. 1, 2012.
(Continued)

*Primary Examiner* — Tho G Phan
(74) *Attorney, Agent, or Firm* — Baker & Hostetler LLP

(57) ABSTRACT

A polarizing reflector for broadband antennas includes a flat dielectric substrate, a patch array layer formed by a bi-dimensionally periodic lattice of thin metallic patches along first and second perpendicular directions x, y, and a ground layer. All the patches have a same shape elongated along the second direction y and form electric dipoles when electrically excited along the second direction y. For each row the patches of the said row are interconnected by an elongated metallic strip oriented along the first direction x and having a width c. The geometry of the patch array, the thickness h and the dielectric permittivity $\varepsilon_r$ of the substrate, and the width c of the elongated metallic strips are tuned so that the patch array including the elongated metallic strips induces a fundamental aperture mode and a complementary fundamental dipolar mode along two orthogonal TE and TM polarizations within a single operating frequency band or two separate operating frequency bands, and the differential phase between the two fundamental modes over the single or the first and second frequency bands being equal to +90° or to an odd integer multiple of ±90°. The polarizing reflector can comprise also a curved substrate and a patch array layer formed by a bi-dimensionally lattice of metallic patches along first curvilinear rows and second curvilinear columns.

18 Claims, 22 Drawing Sheets

(51) Int. Cl.

| | |
|---|---|
| ***H01Q 15/24*** | (2006.01) |
| ***H01Q 21/06*** | (2006.01) |
| ***H01Q 19/10*** | (2006.01) |
| ***H01Q 1/48*** | (2006.01) |

(58) Field of Classification Search
CPC ..... H01Q 15/24; H01Q 19/10; H01Q 19/104; H01Q 5/28; H01Q 1/38; H01Q 1/48; H01Q 21/06; H01Q 21/065
See application file for complete search history.

(56) References Cited

U.S. PATENT DOCUMENTS

| | | | | |
|---|---|---|---|---|
| 5,917,458 | A * | 6/1999 | Ho | H01Q 1/405 343/769 |
| 6,181,281 | B1 * | 1/2001 | Desclos | H01Q 1/38 343/700 MS |
| 7,190,325 | B2 * | 3/2007 | Nagy | H01Q 3/24 343/756 |
| 2016/0372820 | A1 | 12/2016 | Collignon | |

OTHER PUBLICATIONS

Tang, et al., "Low-Profile Compact Dual-Band Unit Cell for Polarizing Surfaces Operating in Orthogonal Polarizations", IEEE Transactions on Antennas and Propagation, vol. 65, Issue: 3, pp. 1472-1477, Mar. 1, 2017.

Sun, et al., "Gradient-index meta-surfaces as a bridge linking propagating waves and surface waves", Nature Materials, vol. 11, No. 5, pp. 426-431, May 1, 2012.

Kärkkäinen, et al., "Frequency selective surface as a polarization transformer", IEE Processing—Microwave Antennas Propagation, vol. 149, No. 516, pp. 248-252, 2002.

Doumanis, et al., "Anisotropic Impedance Surfaces for Linear to Circular Polarization Conversion", IEEE Trans. Antennas and Propagation, vol. 60, No. 1, pp. 212-219, Jan. 2012.

Fonseca, et al., "High-Performance Electrically Thin Dual-Band Polarizing Reflective Surface for Broadband Satellite Applications", IEEE Transactions on Antenas and Propagations, vol. 64, No. 2, pp. 640-649, Feb. 2016.

* cited by examiner

POLARIZING REFLECTOR FOR MULTIPLE BEAM ANTENNAS

CROSS-REFERENCE TO RELATED APPLICATIONS

This application claims priority to foreign European patent application No. EP 17306169.8, filed on Sep. 11, 2017, the disclosure of which is incorporated by reference in its entirety.

FIELD OF THE INVENTION

The present invention concerns polarizing reflectors or reflecting surfaces for antennas, namely for satellite antennas or ground telecommunication antennas, that reflect an impinging electromagnetic wave while performing the polarization conversion from a linear polarization to a circular polarization.

BACKGROUND

The space telecommunication systems, sometimes referred to Satcom systems, often use polarization as a supplemental degree of freedom to increase the spectrum efficiency in multi-beam frequency reuse scheme, and often use circularly polarized electromagnetic (EM) waves to avoid the problems associated with polarization misalignment. This approach is valid for both on-board satellite and terminal antennas. The generation of this circular polarization is known as a sensitive issue and is usually performed at feed level for a reflector antenna.

Most of the current on-board antennas for communication satellite applications, typically broadcasting and broadband applications operating at Ku and Ka band, usually produce circular polarization at elementary feed level by using a polarizing waveguide component, such as a septum polarizer or an iris polarizer. These polarizers are connected to the feeds, and a reflector antenna producing a multiple beam coverage will use as many polarisers as used feeds. These polarizers add mass and contribute to the bulkiness of the feed array, especially in low frequency bands, such as at L, S, C bands.

As an alternative sometimes implemented on terminal antennas of the user ground segment, low power elementary feeds in combination with a polarizing screen are used. This approach often requires a multi-layer design of the screens, resulting in relatively high insertion losses performance and increased manufacturing complexity. Such multi-layer screens are also characterized by relatively poor axial ratio performances over the scanning range and over the frequency bandwidth.

In order to overcome the drawbacks of the solutions cited here above, low profile polarizing surfaces operating with a single band in one polarization handedness for broadband satellite applications have been described in the two following documents.

As a first document, the article from K. Kärkkäinen et al., entitled "Frequency selective surface as a polarization transformer", IEE Processing—Microwave Antennas Propagation, vol. 149, no. 516, pp. 248-252, 2002, describes doubly periodic planar metallo-dielectric arrays supported by a ground plane. When thermal losses or grating lobes are neglected, these structures fully reflect incident plane waves in a specular direction with a tailored phase shift. Among those surfaces, anisotropic designs impose a differential phase shift to the two polarizations of the incoming plane wave. A reflected circularly polarized wave can hence be achieved by means of the differential reflection phase provided by an anisotropic impedance surface.

As a second document, the article from E. Doumanis et al., entitled "Anisotropic Impedance Surfaces for Linear to Circular Polarization Conversion", IEEE Trans. Antennas and Propagation, vol. 60, no. 1, January 2012, pp. 212-219, describes anisotropic impedance surfaces for linear to circular polarization conversion having a same structure as one of the first document.

According to the second document, circular polarization is characterized by electric field where the two orthogonal components are of the same amplitude and 90 degrees (or odd multiples of) out of phase. A linearly polarized wave may be converted to a circularly polarized wave by means of an engineered reflector, which provides this difference in phase between two crossed linear components. By virtue of anisotropy, it is possible to independently control or tune the reflection characteristics of two orthogonal linearly polarized incident plane waves and therefore achieve linear to circular polarization conversion.

The design consists in a regular array of rectangular patches above a ground plane and the phase response is tuned to reflect the two orthogonal plane waves defined with the electric field first x and second y axes (specular TE/TM Floquet modes) in quadrature over a wide frequency range. As a consequence, a linearly polarized plane wave with an inclination of 45 degrees with respect to the x and y axes of the structure would generate at normal incidence a purely circularly polarized signal with the same handedness over the full frequency range. The parameters to tune the response of the surface are the substrate parameter (dielectric constant $\varepsilon_r$ and thickness h), the shape of the rectangular patch (a, b) and its periodicity ($d_x$, $d_y$).

As reported in the second document, such a design exhibits wide frequency band and stable performance in terms of axial ratio with the angle of incidence. This design is considered industrially relevant as it can reuse all the developments related to reflect array antennas for space applications. Having only one layer it is also very attractive as misalignment issues between layers are avoided, leading to better manufacturing yield. Typical results reported in the second document indicate an axial ratio better than 1 dB over wide frequency bandwidths but the concept is often restricted to narrow angular range.

These concepts reported in the same document have elongated profiles. The elementary cell consists of a dipole arranged in a rectangular lattice, very small along the x axis (around $0.1\lambda_g$ at central frequency, where $\lambda_g$ refers to the guided wavelength), but large along the y axis ($0.65\lambda_g$ at central frequency and up to $0.85\lambda_g$ at the highest frequency of the band). This feature makes the design stable to the angle of incidence in the x axis but liable to grating lobes in the y axis, even at very low angles of incidence.

Recently, the low profile polarizing surface of the second document was upgraded to dual band applications with orthogonal polarizations as described in a third document of N. J. G. Fonseca et al., entitled "High-Performance Electrically Thin Dual-Band Polarizing Reflective Surface for Broadband Satellite Applications", IEEE Transactions on Antennas and Propagations, vol. 64, no. 2, February 2016, pp. 640-649. In this anisotropic impedance surface a same linear polarization is converted into a given circular polarization handedness over the first frequency band and into the orthogonal one over the second frequency band. This feature is of interest for communications satellite applications as most of the existing systems use orthogonal polarizations over transmit and receive frequency bands. In this design the longest unit cell dimension is $1.7\lambda_g$ at the higher operating frequency, and blinding effects can be clearly shown all over the band.

Besides, the polarizing surfaces described here above and reported so far in the state of the art have been designed and characterized only for a plane wave excitation. In addition, no polarizing reflectors with a curved profile, such as a paraboloid for example, have been reported. Since such polarizing reflectors span a wide range of angle of incidence, it is an objective to reduce the size of the cell for overcoming the sensitivity to the angle of incidence while maintaining the large band characteristics.

A first technical problem is to increase the stability and/or decrease the sensitivity of the axial ratio with the angle of incidence exhibited by high performance electrically thin polarizing surfaces for broadband satellite applications that convert a same linear polarization into a given circular polarization handedness over one frequency band, or into a given circular polarization handedness over a first frequency band and into the orthogonal one over a second frequency band.

A second technical problem, connected to the first technical problem, is to reduce the size of the elementary cell of such polarizing surface while maintaining the level of axial ratio sensitivity to the angle of incidence and the wide band or dual-band characteristics.

SUMMARY OF THE INVENTION

The invention aims at solving the first technical problem and the second technical problem.

To this end and according to a first embodiment, the invention relates to a polarizing reflector for broadband antennas and for converting a same linear polarization into a given circular polarization handedness over one frequency band when operating in a single wideband at normal incidence illuminated by a plane wave, or into a first given circular polarization handedness over a first frequency band and into a second handedness over a second frequency band, the first and the second circular polarization handedness being substantially equal or orthogonal when operating in dual-band at normal incidence illuminated by a plane wave. The polarizing reflector comprises:

a flat dielectric substrate delimited between a first surface and a second surface, having a thickness h and a dielectric permittivity $\varepsilon_r$;

a patch array layer formed by a bi-dimensionally periodic lattice of thin metallic patches on the first surface of the substrate, the periodic lattice having a first set of patch rows oriented along a first direction x with a periodicity $d_x$ and a second set of patch columns oriented along a second direction y with a second periodicity $d_y$ a ground layer formed by a plain metallic layer on the second surface, located below the patch array layer.

The substrate separates the patch array layer and the ground layer, and all the patches have a same shape elongated along the second direction y and form electric dipoles when electrically excited along the second direction y. The polarizing reflector is characterized in that:

for each row, the patches of the said row have and are all crossed by an elongated metallic strip oriented along the first direction x and having a width c, the elongated metallic strip forming one and a same integral piece, or the patches of the said row are mutually separated and all lined along the first direction x by two elongated metallic strips, each metallic strip having a width c and forming one and a same integral piece; and the geometry of the patch array, the thickness h and the dielectric permittivity $\varepsilon_r$ of the substrate, and the geometry of the elongated metallic strips are tuned so that the patch array including the elongated metallic strips induces a fundamental aperture mode and a complementary fundamental dipolar mode along two orthogonal TE and TM polarizations within the single frequency band when operating at normal incidence in a single wide band or induces a fundamental aperture mode and a first complementary fundamental dipole mode along two orthogonal TE and TM polarizations within the first frequency band and the fundamental aperture mode and a second complementary higher order dipole mode along the two orthogonal TE and TM polarizations within the second frequency band when operating in dual wide band; and the differential reflection phase between the two fundamental aperture and dipole modes over the single band, or the differential reflection phase between the two fundamental aperture and dipole modes over the first frequency band and the differential reflection phase between the fundamental aperture and a higher dipole mode over the second frequency band are equal to ±90° or to an odd integer multiple of ±90°.

According to a second embodiment the invention also relates to a polarizing reflector for broadband antennas and for converting a same linear polarization into a given circular polarization handedness over one frequency band when operating in a single wideband at normal incidence illuminated by a plane wave, or into a first given circular polarization handedness over a first frequency band and into a second handedness over a second frequency band, the first and the second circular polarization handedness being substantially equal or orthogonal when operating in dual-band at normal incidence illuminated by a plane wave. The polarizing reflector comprises:

a flat dielectric substrate delimited between a first surface and a second surface, having a thickness h and a dielectric permittivity $\varepsilon_r$; and a patch array layer formed by a first bi-dimensionally periodic lattice of thin metallic patches and a second bi-dimensionally periodic lattice of thin metallic patches, both laid on the first surface of the substrate; and each of the first and second periodic lattices having a first set of patch rows oriented along a same first direction x with a same periodicity $d_x$ and a second set of patch columns oriented along a same second direction y with a same second periodicity $d_y$; and a ground layer formed by a plain metallic layer on the second surface, located below the patch array layer.

The substrate separates the patch array layer and the ground layer. All the patches have a same shape elongated along the second direction y and form electric dipoles when excited along the second direction y. The polarizing reflector is characterized in that:

for each row of the first lattice and the second lattice, the patches of the said row have and are all crossed by an elongated metallic strip oriented along the first direction x and having a width c, the elongated metallic strip forming one and a same integral piece, and the first and the second lattices of the patches including the elongated metallic strips are geometrically interleaved while being spatially separate; and the geometry of the patch array, the thickness h and the dielectric permittivity $\varepsilon_r$ of the substrate, and the geometry of the elongated metallic strips are tuned so that the patch array induces a fundamental aperture mode and a complementary fundamental dipolar mode along two orthogonal TE and TM polarizations within the single frequency band when operating in a single wide band or induces a fundamental aperture mode and a first complementary fundamental dipole mode along two orthogonal TE and TM polarizations within the first frequency and the fundamental aperture mode and a second complementary higher order dipole mode along two orthogonal TE and TM polarizations within the second frequency band when operating in dual wide band; and the differential reflection phase between the two fundamental aperture and dipole modes over the single band, or the differential reflection phase between the two fundamental aperture and dipole modes over the first frequency and the reflection differential phase between the fundamental aperture and a higher dipole mode over the second frequency band is equal to ±90° or to an odd integer multiple of ±90°.

According to further aspects of the invention which are advantageous but not compulsory, the polarizing reflector according to the first and second embodiments might incorporate one or several of the following features, taken in any technically admissible combination:

for each row of the patch array, the patches of the said row are interconnected and crossed by a continuous elongated metallic strip oriented along the first direction x and having the width c;

the shape of the patches is either a rectangular shape or a connected T-shape or a connected E-shape or a connected spiral E-shape;

all the patches have the same shape and the same geometrical dimensions;

the size of each patch is lower than $\lambda_g/2$, preferably comprised between $\lambda_g/4$ and $\lambda_g/5$ and $\lambda_g$ designates the guided wavelength corresponding to the highest operating frequency;

the geometry of the patch array, the thickness and the dielectric permittivity of the substrate, and the geometry of the elongated metallic strips are tuned so that a first resonance frequency of the dipole mode and a first resonance frequency of the aperture mode, higher than first resonance frequency of the dipolar mode, surround the single frequency wideband of the single operating wideband or the first frequency band of the dual operating band;

the geometry of the patch array, the thickness and the dielectric permittivity of the substrate, and the geometry of the elongated metallic strips are tuned so that a first resonance frequency of the dipole mode and a first resonance frequency of the aperture mode, higher than first resonance frequency of the dipole mode, surround the single frequency wideband of the single operating wideband or the first frequency band of the dual operating band, and the first resonance frequency of the aperture mode is located before the second frequency band of the dual operating band;

the geometry of the patch array, the thickness h and the dielectric permittivity $\varepsilon_r$ of the substrate, and the geometry of the elongated metallic strips are tuned so that the differential phase between the two fundamental modes over the single or the first and second frequency bands are equal respectively to +90° and −90° or +270° or −270°.

According to a third embodiment the invention also relates to a flat polarizing reflector for a broadband antenna locally illuminated at normal or oblique incidence by an electromagnetic source having a predetermined radiation pattern to the flat polarizing reflector and for converting locally a linear polarization into a given local circular polarization handedness over one frequency band when operating in a single wideband at a local normal or oblique incidence illuminated by a local plane wave originated from a predetermined source radiation pattern, or into a first local circular polarization handedness over a first frequency band and into a second local polarization handedness over a second frequency, the first and the second local circular polarization handedness being substantially equal or orthogonal when operating in dual-band at normal or oblique incidence illuminated by a local plane wave. The polarizing reflector comprises:

a flat profile dielectric substrate, delimited between a first flat surface with a first flat profile and a second flat surface with a second flat profile, and having a thickness h and a dielectric permittivity $\varepsilon_r$;

a patch array layer formed by a bi-dimensionally flat lattice of thin metallic patches on the first surface of the substrate, the flat lattice having a first set of linear patch rows and a second set of linear patch columns;

a ground layer formed by a plain metallic layer on the second surface, located below the patch array layer.

The substrate separates the patch array layer and the ground layer, and all the patches have a same elongated shape and form electric dipoles when excited along their own direction of elongation. The polarizing reflector is characterized in that:

for each patch row, the patches of the said patch row are crossed by an elongated metallic strip having a reference width c, or the patches of the said patch row are lined by two elongated metallic strips having a reference width and the geometry of the patch array, the thickness h and the dielectric permittivity of the substrate, and the geometry of the elongated metallic strips are tuned so that each phasing cell, made of an elongated electric dipole and a portion of the elongated metallic strip crossing the said elongated electric dipole or made of an elongated electric dipole and a portion of the two elongated metallic strip lining the said elongated electric dipole, laid on the grounded flat substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands is equal to ±90° or to an odd integer multiple of ±90°.

According to a fourth embodiment the invention also relates to a curved polarizing reflector for a broadband antenna locally illuminated at normal or oblique incidence by an electromagnetic source having a predetermined radiation pattern to the curved polarizing reflector and for converting locally a linear polarization into a given local circular polarization handedness over one frequency band when operating in a single wideband at a local normal or oblique incidence illuminated by a local plane wave originated from a predetermined source radiation pattern, or into a first local circular polarization handedness over a first frequency band and into a second local polarization handedness over a second frequency band, the first and the second local circular polarization handedness being substantially equal or orthogonal when operating in dual-band at normal or oblique incidence illuminated by a local plane wave. The polarizing reflector comprises:

a curved profile dielectric substrate, delimited between a first curved surface with a first curved profile and a second curved surface with a second curved profile, and having a thickness h and a dielectric permittivity $\varepsilon_r$;

a curved patch array layer formed by a bi-dimensionally curved lattice of thin metallic patches on the first surface of the substrate, the curved lattice having a first set of curvilinear patch rows and a second set of curvilinear patch columns;

a ground layer formed by a plain metallic layer on the second surface, located below the patch array layer.

The substrate separates the patch array layer and the ground layer, and all the patches have a same substantially elongated shape and forming electric dipoles when excited along their own direction of elongation. The polarizing reflector is characterized in that:

for each curvilinear patch row, the patches of the said curvilinear patch row are crossed by an elongated metallic strip having a reference width c, or the patches of the said curvilinear patch row are lined by two elongated metallic strips having a reference width c; and the geometry of the patch array, the thickness h and the dielectric permittivity of the substrate, and the geometry of the elongated metallic strips is tuned so that each phasing cell, made of an elongated electric dipole and a portion of the elongated metallic strip crossing the said elongated electric dipole or made of an elongated electric dipole and a portion of the two elongated metallic strips lining the said elongated electric dipole, laid on the grounded curved substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands is equal to ±90° or to an odd integer multiple of ±90°.

According to further aspects of the invention which are advantageous but not compulsory, the polarizing reflector according to the third or the fourth embodiment might incorporate one or several of the following features, taken in any technically admissible combination:

for each phasing cell, while keeping unchanged the local longitudinal direction of the portion of the single crossing elongated metallic strip or the two lining elongated metallic strips, the elongated electric dipole is turned about the local normal to the first surface at the location of the phasing cell by a tuning polarization oriented angle A so that the corresponding axial ratio of the phasing cell is a minimum;

the tuning polarization oriented angle A is expressed by the equation: $A=k\cdot A0$, A0 designating a reference tuning polarization oriented angle to turn only the electric dipole about the local normal so that the polarization angle $\alpha$ separating the local elongation direction of the turned electric dipole included in the local tangent plane to the first surface at the location of the phasing cell and the tangential component of the local incident electrical field in the local tangent plane is substantially equal to a same value equal to +45° or 45°, and k designating a positive real number equal or higher than 1 that depends on the level of the patch row the phasing cell belongs to and that minimizes the axial ratio of the phasing cell;

the curved patch array corresponds to a virtual flat profile reference patch array formed by a bi-dimensionally reference periodic lattice of thin virtual reference metallic patches, the reference periodic lattice having a first reference set of patch rows oriented along a first reference direction x' with a periodicity $d_x$, and a second reference set of patch columns oriented along a second reference direction y' with a second periodicity $d_y$, and for each virtual reference patch row, the reference patches of the said patch row are crossed by a virtual reference elongated metallic strip generally oriented along the first reference direction x' and having a reference width c, or the reference patches of the said reference patch row are lined by two virtual reference elongated metallic strips generally oriented along the first reference direction x' and having a reference width c and to each phasing cell of the curved polarizing reflectors corresponds a virtual flat reference phasing cell made of a virtual elongated electric dipole and a portion of the virtual elongated metallic strip crossing the said virtual elongated electric dipole or made of a virtual elongated electric dipole and a portion of the two virtual elongated metallic strips lining the said virtual elongated electric dipole, laid on a virtual grounded flat substrate having a permittivity $\varepsilon_r$ and a thickness h, the elongation direction of the virtual elongated electric dipole being rotated from a predetermined angle to the second reference direction y' so that the said dephasing cell of the curved polarizing reflector induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands is equal to ±90° or to an odd integer multiple of ±90°;

the curved patch array is a projection of the virtual flat profile reference patch array generally located closest to the first surface of the substrate;

the first curved surface is a portion of a circular cylinder or a parabolic cylinder or an elliptic cylinder or a hyperbolic cylinder, and the virtual flat profile reference path array is the curved patch array developed on a flat surface;

the virtual flat reference patch rows are sets of rectangular patches regularly spaced, the width and the length of the patches being modulated according to the direction of the rows, and/or the shape of the patches is either a rectangular shape or a connected T-shape or a connected E-shape or a connected spiral E-shape.

According to further aspects of the invention which are advantageous but not compulsory, the polarizing reflector according to the first, second, third and fourth embodiments might incorporate the following feature: the polarizing reflectors as defined here above are suited to broadband satellite application and have a thin flat or thin curved profile.

BRIEF DESCRIPTION OF THE DRAWINGS

The invention will be better understood on the basis of the following description which is given in correspondence with the annexed figures and as an illustrative example, without restricting the object of the invention. In the annexed figures.

DETAILED DESCRIPTION

The underlying concept is to include one or several elongated metallic strips having a width c, either connecting each row of the elongated patches of a conventionally designed polarizing reflector, or lining each row of the elongated patches of a conventionally designed polarizing reflector. By tuning the width c of the added metallic strips and the relevant geometrical parameters of the patch array, the RF performance of the polarizing reflector, in particular the stability of axial ratio over a wide angular range, are significantly improved.

Figure 1A:
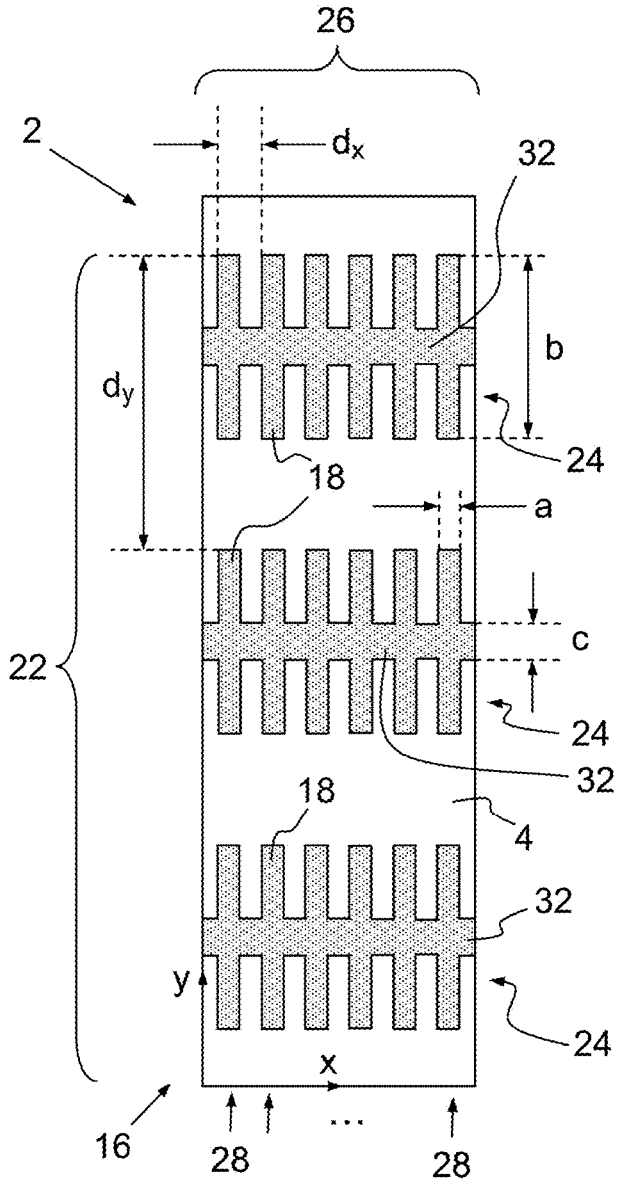
FIGS. 1A and 1B are respectively a front view and a side view of a polarizing reflector according to a first embodiment of the invention.
Figure 1B:
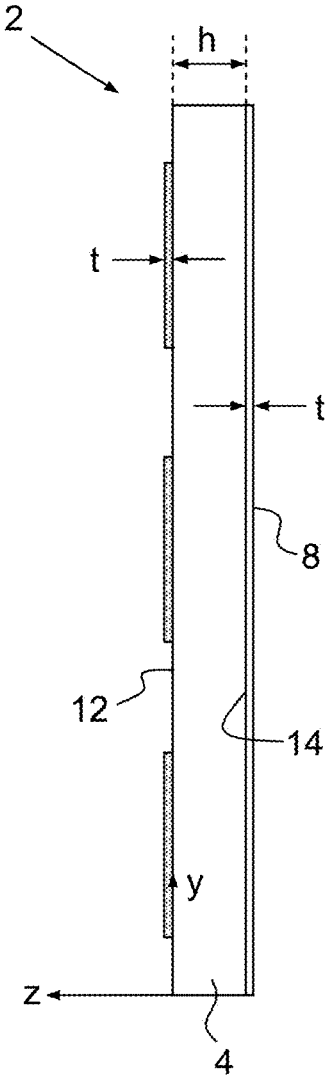

According to the FIGS. 1A-1B and a first embodiment of the invention, a polarizing reflector 2 suited to broadband satellite applications is configured for converting a same linear polarization into a given circular polarization handedness over one frequency band, or into a given circular polarization handedness over a first frequency band and into the orthogonal handedness over a second frequency band.

The polarizing reflector 2 comprises a flat dielectric substrate 4, a patch array layer 6 and a ground layer 8.

The flat dielectric substrate 4 is delimited between a first surface 12 and a second surface 14, having a thickness h and a dielectric permittivity $\varepsilon_r$.

The patch array layer 6 is formed by a bi-dimensionally periodic lattice 16 of thin metallic patches 18 laid on the first surface 12 of the substrate 4, the periodic lattice 16 having a first set 22 of patch rows 24 oriented along a first direction x with a periodicity $d_x$ and a second set 26 of patch columns 28 oriented along a second direction y with a second periodicity $d_y$.

The ground layer 8 is formed by a plain metallic layer on the second surface 14, located below the patch array layer 6, and the dielectric substrate 4 separates the patch array layer 6 and the ground layer 8.

All the patches 18 have a same shape elongated along the second direction y and form electric dipoles when electrically excited along the second direction y.

Here, the metallic patches 18 are rectangular and have each a same length b, a same width a and a same thickness t.

The polarizing reflector is characterized by the following features.

For each row 24 the patches of the said row are interconnected by an elongated metallic strip 32 oriented along the first direction x and having a width c, the elongated metallic strip 32 forming one and a same integral piece.

As a variant of the first embodiment of the invention, for each row the patches of the said row are disconnected, i.e. mutually separated by an isolating gap, and the patches of the said row are lined along the first direction x by two elongated metallic strips, each metallic strip having a width c and forming one and a same integral piece.

The geometry of the patch array layer 6, the thickness h and the dielectric permittivity $\varepsilon_r$ of the substrate 4, and the width c of the elongated metallic strips 32 are tuned so that the patch array 6 induces a fundamental aperture mode and a complementary fundamental dipolar mode along two orthogonal TE and TM polarizations within the single frequency band when operating in a single wide band or within the first frequency band and the second frequency band when operating in dual wide band.

The differential reflection phase between the two fundamental modes over the single or the first and second frequency bands is equal to ±90° or to an odd integer multiple of ±90°.

The properties of the polarizing surface formed by the patch array 6, including the crossing elongated metallic strips 32, are characterized by its response to two orthogonal linearly polarized incident plane waves. The two plane waves, commonly referred to as TE and TM waves are characterized in that they have their electric and magnetic fields transverse to the xz-plane, respectively. In the planar structure of the first embodiment, the TE and TM waves are defined in a similar way with reference to the plane containing the direction of wave propagation and the z-axis. Unless otherwise stated, TE and TM waves are defined with respect to the xz-plane. Consequently at normal incidence, the TE wave has its electric field linearly polarized along the y-axis and the TM wave along the x-axis. The structure being periodic, its response can be expanded as an infinite superposition of space harmonics, also known as Floquet modes, the TE and TM waves mentioned above being the two orthogonal fundamental modes When higher order Floquet modes are below cut-off frequency (i.e. no grating lobes appear in the visible domain), the TE and TM incident wave are reflected in the specular direction.

Using patches 18 with a high aspect ratio, as in the first embodiment, results in an anisotropic impedance surface (AIS) response introducing a differential reflection phase in the reflected TE and TM waves. Thus exciting the surface with an impinging combination of TE and TM waves in phase, corresponding at normal incidence to a linearly polarized electric field +45 or −45° with respect to the x-axis, would produce a circularly polarized reflected field, provided the differential reflection phase between the two fundamental modes is ±90° or an odd integer multiple of ±90°.

Thus, the polarizing reflector 2 operates between two different resonant fundamental modes along the TE and TM polarizations. One first mode corresponds to the conventional resonance of a periodic dipolar array while a second mode corresponds to the resonance of a periodic aperture array surrounded by metallic grids, the metallic grids being formed by the elongated metallic strips 32 and their respective crossed and interconnected elongated patches 18.

Figure 2:
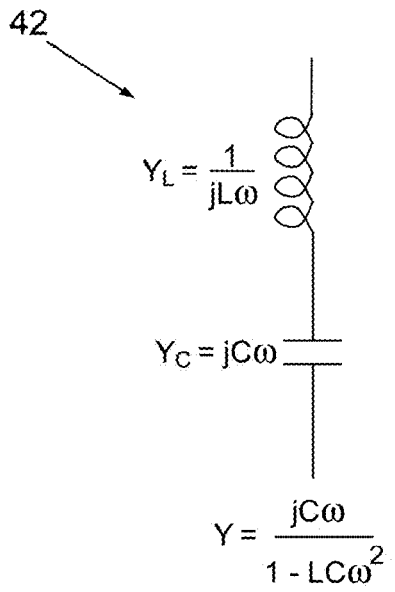
FIG. 2 is the LC series equivalent electrical circuit of the patch array described in the FIGS. 1A-1B operating in dipolar and capacitive mode through the metallic elongated patches along a TE polarization.
Figure 3:
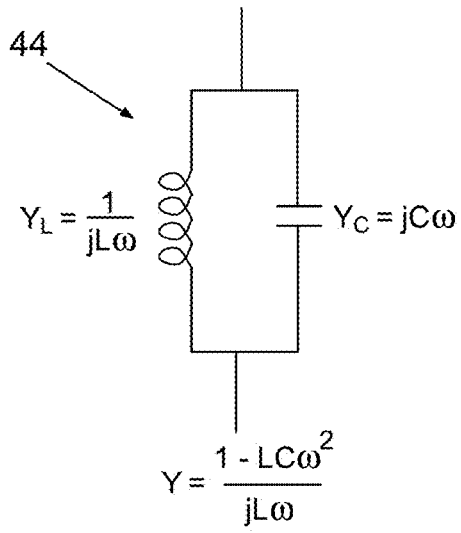
FIG. 3 is the shunt equivalent electrical circuit of the patch array described in the FIGS. 1A-1B operating in aperture and inductive mode through its grid structure along a TM polarization.

The periodic dipole array operates as a series LC equivalent circuit 42 illustrated in FIG. 2 while the periodic aperture array operates as a shunt LC equivalent circuit 44 illustrated in FIG. 3.

For the small dimensions of the aperture elements forming the aperture array and for the small dimensions of the dipole elements forming the dipole array, the equivalent circuit is mostly dominated by the inductance for the aperture element, and the capacitance for the dipole element.

Figure 4:
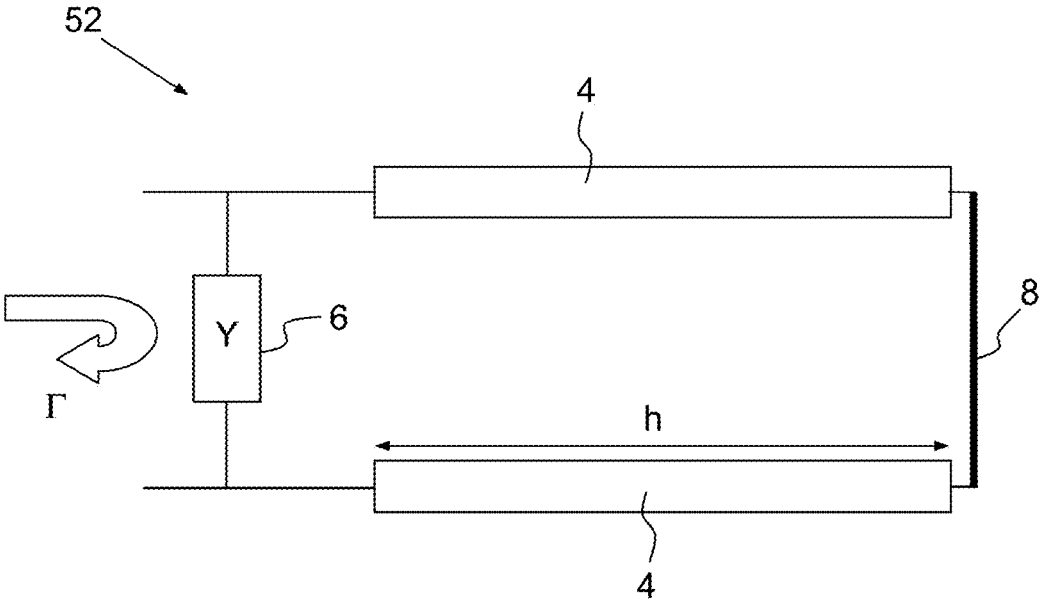
FIG. 4 is the transmission line equivalent circuit of the polarization reflector of the FIGS. 1A-1B.

When these aperture and dipole elements are located above the ground plane layer the resulting equivalent circuit 52 of the engineered surface or polarizing reflector, i.e. the grounded substrate and the aperture and dipole array, can be illustrated by a transmission line as shown in FIG. 4.

Figure 5:
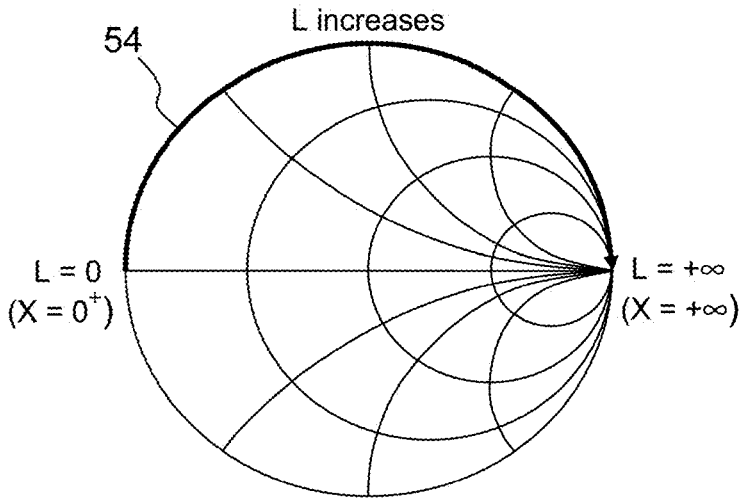
FIG. 5 is a Smith chart plot that illustrates the evolution of the equivalent impedance of the patch array of FIGS. 1A-1B corresponding to the TM resonant mode within the aperture structure of the patch array when the equivalent inductance L of the shunt LC equivalent circuit increases from zero to infinity and when the effect of the capacitance is negligible and the substrate thickness is a quarter wavelength.
Figure 6:
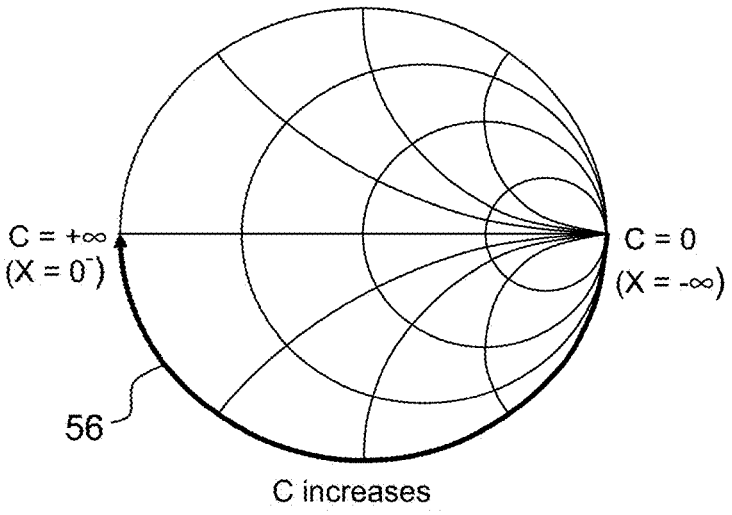
FIG. 6 is a Smith chart plot that illustrates the evolution of the equivalent impedance of the patch array of FIGS. 1A-1B corresponding to the TE resonant mode in the dipoles of the patch array when the equivalent capacitance C of the series LC equivalent circuit increases from 0 to infinity and when the effect of the inductance is negligible and the substrate thickness is a quarter wavelength.

In the lossless case, the magnitude of the reflection coefficient F from the combined structure is unity. Therefore on a Smith chart the equivalent impedance of the combined surface lies on the $|\Gamma|=1$ circle as shown in the FIGS. 5 and 6.

When the separation between the dipole and aperture array and the ground plane layer is a quarter of wavelength, the admittance of the polarizing reflector is the admittance of the dipole and aperture array. Accordingly for small dimensions of the resonant elements, the polarizing reflector 2 exhibits inductive impedance 54 and capacitive impedance 56 for the respective aperture array and dipole array, as shown respectively in the FIG. 5 and the FIG. 6.

It is therefore relatively straightforward to synthesize along the TE and TM polarisations two complementary admittances, i.e. one inductive and one capacitive, which generate reflection coefficients with a 90° or a 270° phase difference and that evolve relatively slowly with frequency in one given single operating wide band.

With such an approach, a polarising reflecting surface or thin polarizing reflector 2 can be synthesized by tuning the geometry of the dipole patch array 16 and the width c of the elongated metallic strips 32 so that a first resonance frequency of the dipolar mode and a first resonance frequency of the aperture mode, higher than first resonance frequency of the dipolar mode, are respectively and closely located before and after the given single operating frequency wideband.

More generally the geometry of the patch array 6, the thickness t and the dielectric permittivity of the substrate, and the width c of the elongated metallic strips 32 can be tuned so that a first resonance frequency of the dipolar mode and a first resonance frequency of the aperture mode, higher than first resonance frequency of the dipolar mode, surround the single frequency wideband of the single operating wideband or the first frequency band of the dual operating wide band and the size of the resonant element is small.

Accordingly the structure as described here above for the thin polarizing reflector 2 according to the first embodiment, increases the stability and decreases the sensitivity of the axial ratio with the angle of incidence of an impinging electromagnetic wave.

Figure 7A:
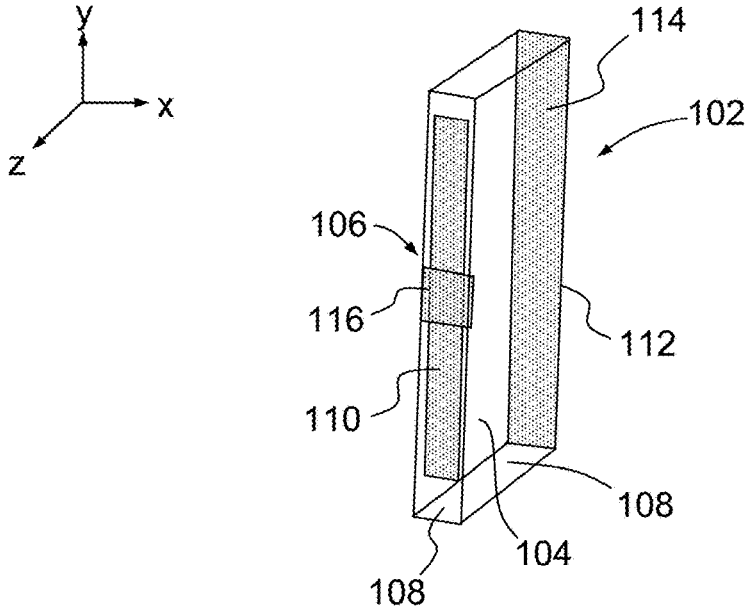
FIGS. 7A, 7B, 7C and 7D are respectively a structural view of an elementary cell of the polarizing reflector of the FIGS. 1A-1B, the shape of the patch of the elementary structure being rectangular and elongated along the polarization of the TE mode and crossed centrally by a metallic strip, a first chart of an example of the evolution of the phases versus frequency of the reflected TM resonant mode and the TE resonant mode, corresponding to an operation in a single band and a tuning of the elementary cell according to the invention, a second chart of simulated axial ratio performance at oblique incidence along xz-plane, and a third chart of simulated axial ratio performance at oblique incidence along yx-plane.
Figure 7B:
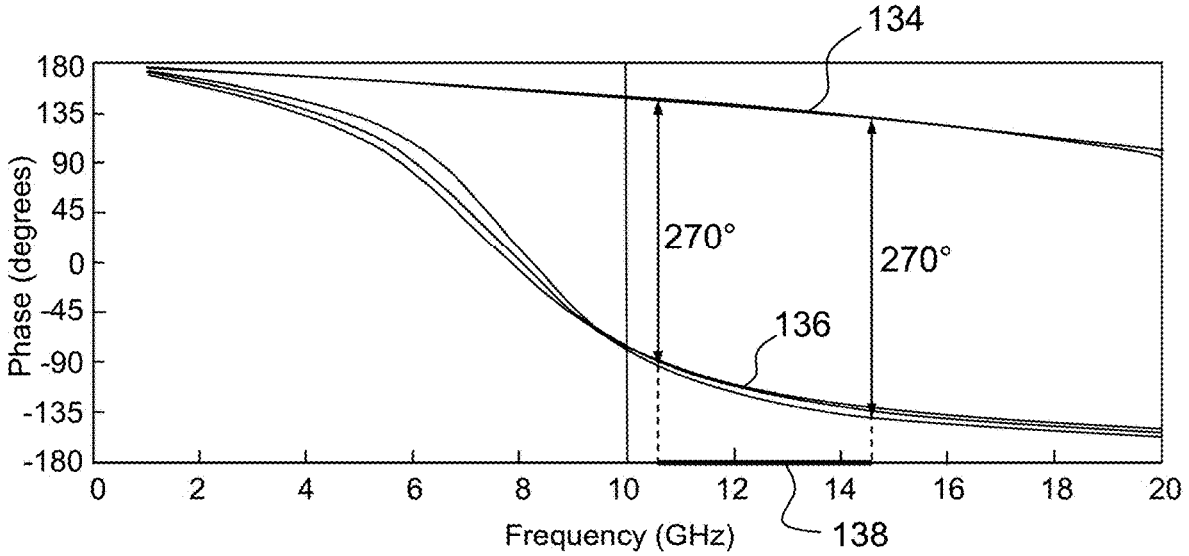
Figure 7C:
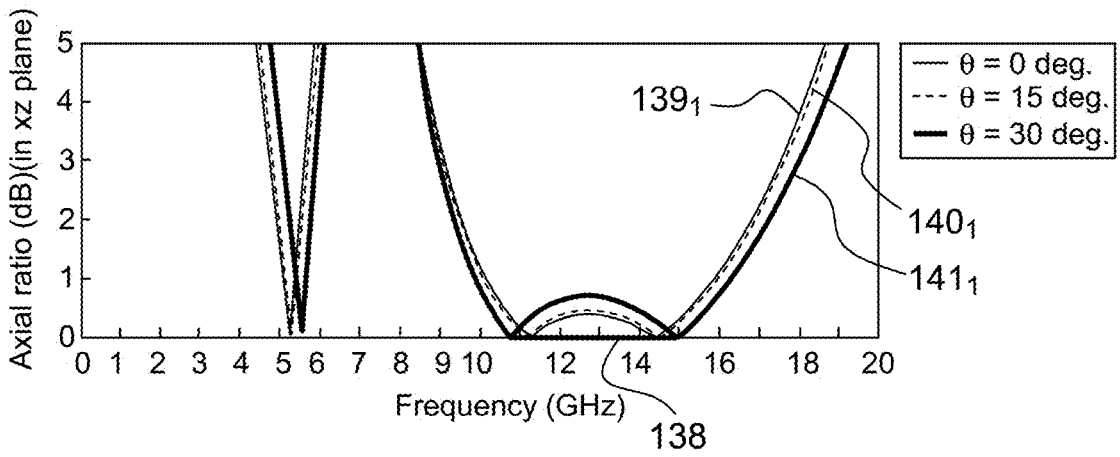
Figure 7D:
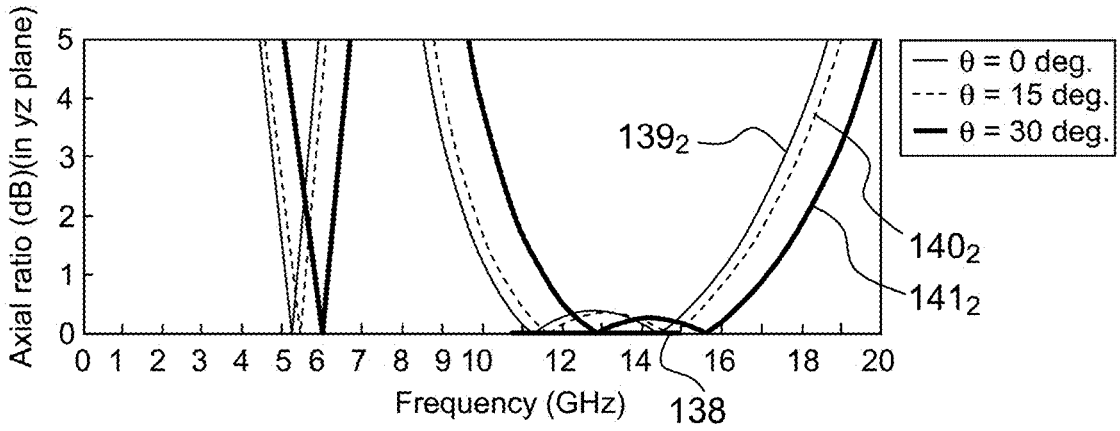
Figure 8A:
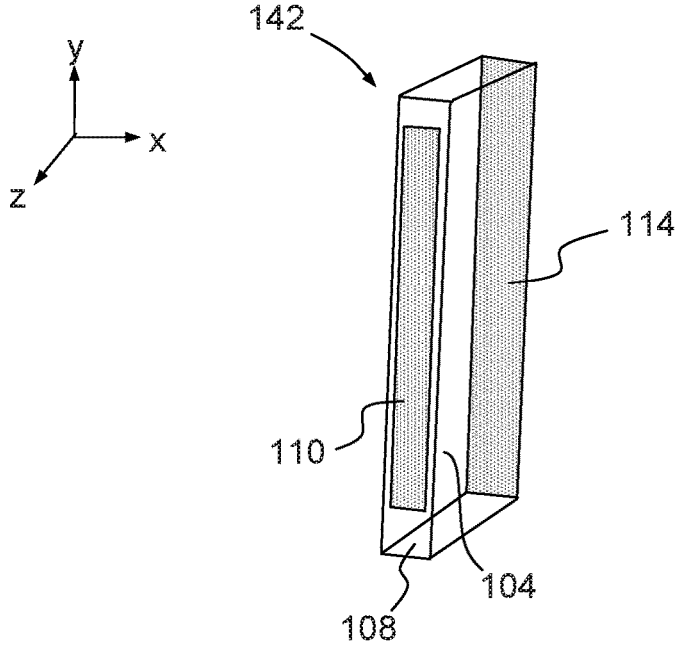
FIG.8A PRIOR ART
FIGS. 8A and 8B are respectively a structural view of an elementary cell of a conventional polarizing reflector, the shape of the patch of the elementary structure differing from the patch of the elementary cell of FIG. 7A by the absence of a crossing elementary strip, and a chart of the evolution of the phases versus frequency of the reflected TM resonant mode and the TE resonant mode, corresponding to an operation in a single band and a conventional tuning of the conventional polarizing reflector.
Figure 8B:
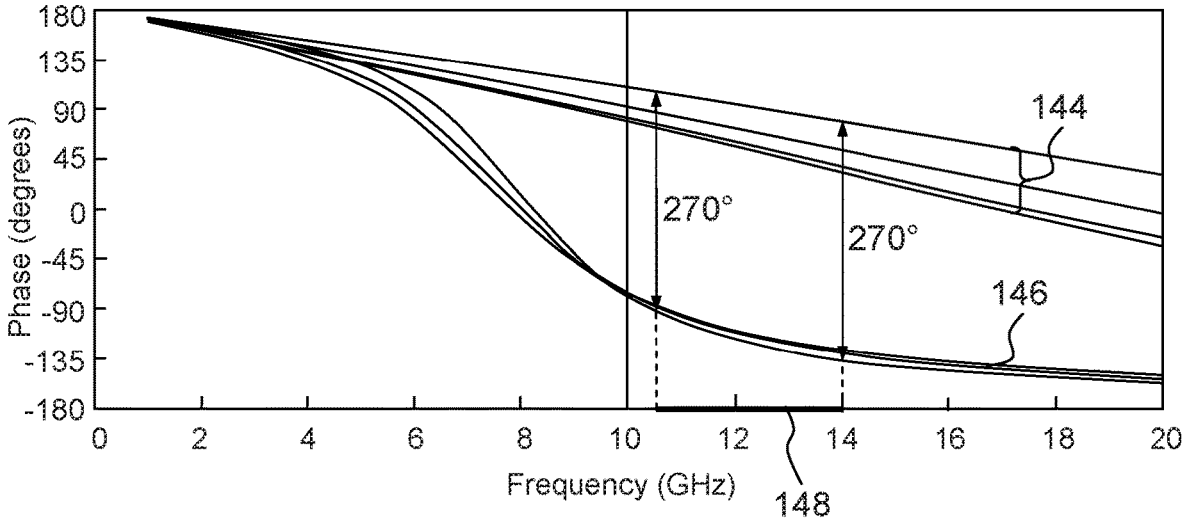
FIG.8B PRIOR ART

As shown in the FIGS. 7B, 7C and 7D, the RF performance both in terms of frequency bandwidth and axial ratio stability angular range, of the polarizing reflector 2 according to the first embodiment are enhanced compared to one of an conventional polarizing reflector as shown in the FIGS. 8A-8B.

According to FIG. 7A, an elementary cell 102 of the polarizing reflector 2 of the FIGS. 1A and 1B is illustrated. Generally the elementary cell is a basic generic structural element that repeated periodically over the surface of the polarizing reflector 2 form the said polarizing reflector 2. In other words the polarizing reflector 2 is made up with a set of elementary cells 102 adjoining each other and paving a given surface, here rectangular, of the polarizing reflector 2.

The elementary cell 102 is a piece of the dielectric substrate 104, having a parallelepiped shape, covered on a central area 106 of a first face 108 of the parallelepiped oriented along the z axis by one rectangular metal patch 110 elongated along the y axis, and covered plainly on a second face 112 of the parallelepiped, opposite to the first face 108, by a metallic ground layer 114. The elementary cell 102 also includes on its first face 108 an elementary crossing strip 116, being part of a metallic strip 32 elongated along the y axis, crossing the middle of the elongated patch 110 and extending fully along the x axis.

As a variant the elementary crossing strip of the elementary cell may cross the elongated patch at a position along the y axis located within a predetermined range around the middle of the said elongated patch.

The dimensions of the parallelepiped are respectively $d_x$, $d_y$, h along the x, y, z axis while the planar dimensions of the elongated patch are respectively a, b along the x, y axis and the thickness of the elongated patch, the elementary crossing strip 116 and the ground layer 114 is equal to the thickness t.

Figure 9A:
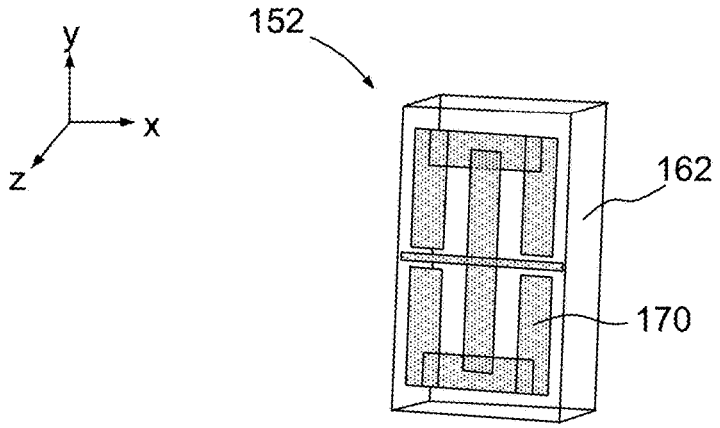
FIGS. 9A, 9B, 9C, 9D are respectively a structural view of a first variant of an elementary cell of a polarizing reflector according to the first embodiment of the invention, the shape of the patch of the elementary structure being a connected E-shape and elongated along the polarization of the TE mode and crossed centrally at a connection level by a metallic strip, a first chart of an example of the evolution of the phases versus frequency of the reflected TM resonant mode and the TE resonant mode, corresponding to an operation in dual-band and a tuning of the elementary cell according to the invention, a second chart of simulated axial ratio performance at oblique incidence along xz-plane, and a third chart of simulated axial ratio performance at oblique incidence along yx-plane.
Figure 9B:
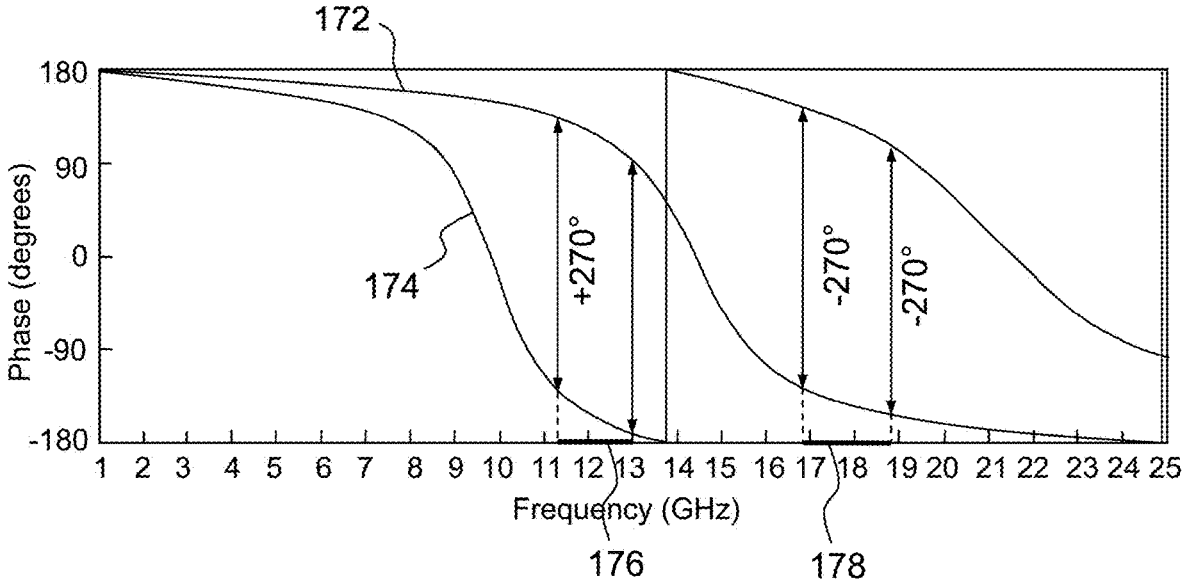

As an example of tuning and as shown in FIG. 9B, assuming a time-harmonic dependence given by $e^{j\omega t}$ and defining handedness from the point of view of the source, a differential reflection phase of +270° between TE and TM waves, i.e., $\varphi^{TM}-\varphi^{TE}=3\pi/2$ where $\varphi^{TM,TE}$ is the phase of the complex phasor representing the reflected TM, TE field, will convert at normal incidence linearly polarized electric field at +45° with respect to the x-axis into a field with right-hand circular polarization (RHCP) while an incident linearly polarized electric field at −45° with respect to the x-axis will be converted into a field with left hand polarization (LHCP).

According to the FIG. 7B a first set of curves 134 illustrates the evolution of the phase versus frequency of the reflected TM resonant mode for different incidence angular value θ of the incident TM wave to the normal incidence equal to 0°, 15°, 30° and 45°, while a second set of curves 136 illustrates the evolution of the phase versus frequency of the reflected TE resonant mode for different incidence angular value of the incident TM wave to the normal incidence equal to 0°, 15°, 30° and 45°.

The FIG. 7B shows a 270° phase difference of the reflecting coefficients of the TM and TE modes that evolves relatively slowly with frequency in the given single operating wide band taken into account to tune both the aperture array and dipole array, here referenced by the numeral reference 138 and comprised between 10.2 GHz and 14.9 GHz.

The dispersion of the phase difference around 270° over the operating wide single band 138 is small since the dispersion of the phase of the reflected TM over the same band 138, shown by the first set curves 134 as well as the dispersion of the phase of the reflected TE over the same band 138, shown by the second set of curves 136, are small. This small dispersion of the phase difference translates into a stability and a low sensitivity to incidence angular variation of the axial ratio as shown in the FIGS. 7C and 7D.

As shown by the FIGS. 7C and 7D, the response of the single band polarizing reflector having the elementary cell 102 of the FIGS. 7A-7B has been evaluated by a simulation for oblique incidence, with specific attention to the performance over the single band 138.

In a standard spherical coordinate system (θ, φ), the response of the anisotropic impedance surface formed by the polarizing reflector is here simulated for different θ angles in the xz-plane (φ=0°) and the yz-plane (φ=90°). The corresponding axial ratio versus frequency is illustrated in the FIG. 7C (xz-plane) by three curves $139_1$, $140_1$, $141_1$ corresponding to an incidence angle θ of 0°, 15° and 30°, and in the FIG. 7D (yx-plane) by three curves $139_2$, $140_2$, $141_2$ corresponding to an incidence angle θ of 0°, 15° and 30°.

From these curves $139_1$, $140_1$, $141_1$, $139_2$, $140_2$, $141_2$ the single band reflecting polarizer exhibits a stable axial ratio within the single band 138 and is particularly not affected by grating lobes in both planes.

The dispersion of the phase difference around 270° is smaller than the dispersion of the phase difference observed for a conventional similar polarizing reflector as shown in the FIGS. 8A-8B.

Accordingly the polarizing reflector 2 according to the first embodiment of the invention has a greater stability and a lower sensitivity to the angular variation of the axial ratio over the single operating band than the conventional polarizing reflector of FIGS. 8A-8B.

As shown in FIG. 8A, an elementary cell 142 of a conventional polarizing reflector similar to the polarizing reflector of FIGS. 1A-1B differs from the elementary cell 102 of FIG. 7A only in that the elementary cell 142 does not include on its first face 108 an elementary crossing strip, being part of a metallic strip elongated along the axis y, crossing the middle of the elongated patch 110 and extending fully along the x axis.

According to the FIG. 8B a first set of curves 144 illustrates the evolution of the phase versus frequency of the reflected TM resonant mode for different incidence angular value θ of the incident TM wave to the normal incidence equal to 0°, 15°, 30° and 45°, while a second set of curves 146 illustrates the evolution of the phase versus frequency of the reflected TE resonant mode for different incidence angular value of the incident TM wave to the normal incidence equal to 0°, 15°, 30° and 45°.

The FIG. 8B shows a 270° phase difference of the reflecting coefficients of the TM and TE modes that evolves relatively slowly with frequency in the given single operating wide band taken into account to tune both the aperture array and dipole array, here referenced by the numeral reference 148 and comprised between 10.8 GHz and 14.0 GHz.

The dispersion of the phase difference around 270° over the operating wide single band 148 is significant since the dispersion of the phase of the reflected TM over the same band 148, shown by the first set curves 144 is great and significant while the dispersion of the phase of the reflected TE over the same band 148 is small. This significant dispersion of the phase difference translates into a stability of the axial ratio lower, or a sensitivity of the axial ratio to incidence angular variation greater than the stability and the sensitivity of the polarizing reflector of the FIGS. 1 and 7A.

Generally, the shape of the patches is either a rectangular shape or a connected T-shape or a connected E-shape or a connected spiral E-shape.

Particularly, when the profile of the polarizing reflector is flat, all the patches have the same shape and the same geometrical dimensions.

The size of each patch is lower than $\lambda_g/2$, preferably comprised between $\lambda_g/4$ and $\lambda_g/5$, $\lambda_g$ being the guided wavelength of the upper operating frequency.

According to FIGS. 9A-9B and a first variant, a flat polarizing reflector 152 is derived and differs from the polarizing reflector 2 of the FIGS. 1A-1B and the FIGS. 7A-7B in that the rectangular shape of the patches is replaced by a connected E-shape and in that the tuning of the aperture array and the dipolar array, obtained from the connected E-shape patches crossed along each row thereof by a different elongated metallic strip, is carried out in order to operate in a given dual band according a first given operating band and a second given operating band with polarizations having opposite handedness.

As shown in the FIG. 9A, an elementary cell 162 of the dual-band polarizing reflector 152 is based on the structure of the elementary cell 102 wherein only the rectangular metal patch 110 elongated along the y axis has been replaced by a connected E-shape metal patch 170.

By using such elementary cells 162, the dual-band polarising reflecting surface or dual-band polarizing reflector 152 can be synthesized for operating in dual-band. Such a synthesis is carried out by tuning the geometry of the dipole array formed by the patches 170 and the width c of the elongated metallic strips so that a first resonance frequency of the dipolar mode and a first resonance frequency of the aperture mode, higher than first resonance frequency of the dipolar mode, surround the first given frequency band of the dual operating band, and the first resonance frequency of the aperture mode is located before the second frequency band of the dual operating band.

More generally, the geometry of the dipole patch array, the thickness t and the dielectric permittivity of the substrate, and the width c of the elongated metallic strips are tuned so that a first resonance frequency of the dipolar mode and a first resonance frequency of the aperture mode, higher than first resonance frequency of the dipolar mode, surround the first frequency band of the dual operating band, and the first resonance frequency of the aperture mode is located before the second frequency band of the dual operating band.

More specifically, a circular polarization with low axial ratio and a first handedness can be achieved over the first frequency band that corresponds to the end of the resonance of the dipole mode and to the beginning of the resonance of the aperture mode. Over this first frequency band, the phase difference between the reflection coefficients for the TE and TM waves are equal to +270°.

A circular polarization with opposite handedness and low axial ratio can be achieved over the second frequency band that corresponds to the end of the aperture mode and to the beginning of the resonance of the higher order dipole mode. Over this second frequency band, the phase difference between the reflection coefficients for the TE and TM waves are equal to −270°.

As an example of tuning and as shown in FIG. 9B, assuming a time-harmonic dependence given by $e^{j\omega t}$ and defining handedness from the point of view of the source, a differential reflecting phase of +270° between TE and TM waves, i.e., $\varphi^{TM}-\varphi^{TE}=3\pi/2$ where $\varphi^{TM,TE}$ is the phase of the complex phasor representing the reflected TM, TE field, will convert an incident linearly polarized electric field at +45° with respect to the x-axis into a field with right-hand circular polarization (RHCP) while an incident linearly polarized electric field at −45° with respect to the x-axis will be converted into a field with left hand polarization (LHCP). If the differential reflection phase between the TE and TM waves is instead of −270°, the handedness of the reflected circularly polarized fields is inverted. In the FIG. 9B the evolution of the phase of the complex phasor representing the reflecting TM field and the evolution of the phase of the complex phasor representing the reflecting TE field are respectively illustrated by a first curve 172 and a second curve 174.

It should be noted that as variants other tunings can be implemented and generally the geometry of the patch array, the thickness h and the dielectric permittivity $\varepsilon_r$ of the substrate, and the width c of the elongated metallic strips are tuned so that the differential reflection phase between the two fundamental modes over the single or the first and second frequency bands are equal respectively to +90° and −90° or +270° or −270°.

As shown by the FIGS. 9A and 9B, a connected E-shape dipole array combined with an aperture array obtained by crossing the patch rows with elongated metal strips has been synthesized that exhibits a ±270° phase difference between the reflection modes in 12 and 18 GHz sub-bands, referenced respectively by the numeral references 176 and 178. An aperture mode is induced between the grids, and a dipole mode is excited in the folded dipole formed by the connected E-shape of the dipole. The largest dimension of the patch element is only $0.52\lambda_g$ at the highest frequency of the band, i.e. more than three time smaller that the size of patches used in the conventional polarizing reflector as described in the third cited document.

Figure 9C:
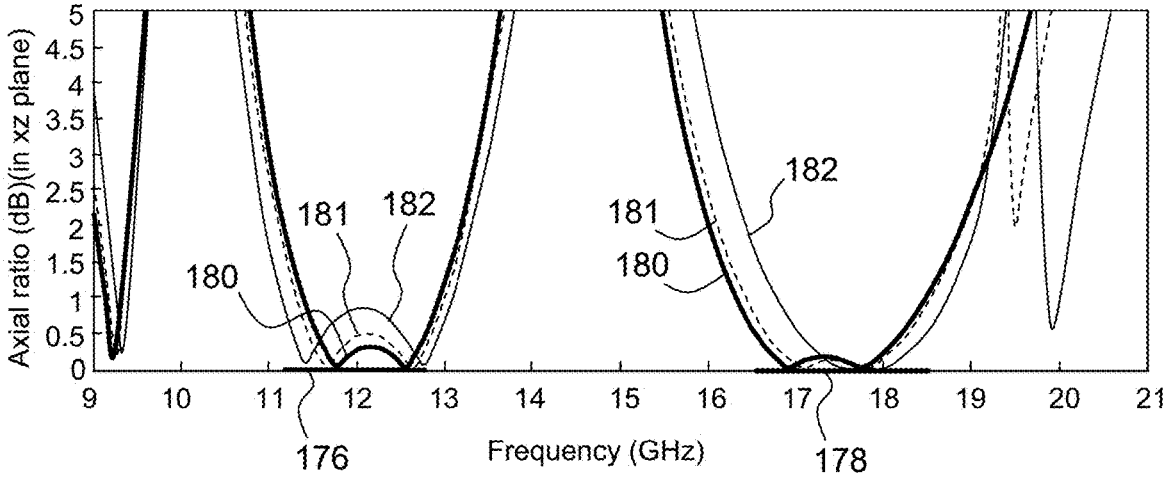
Figure 9D:
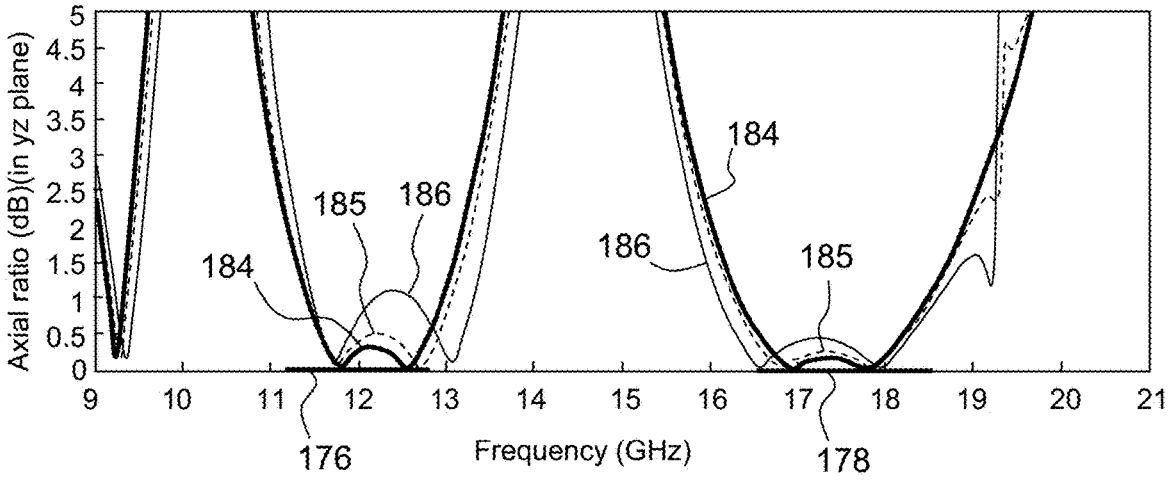

As shown by the FIGS. 9C and 9D, the response of the dual-band band polarizing reflector of the FIGS. 9A-9B has been evaluated by a simulation for oblique incidence, with specific attention to the performance over the two operating bands 176 and 178.

In a standard spherical coordinate system (θ, φ), the response of the anisotropic impedance surface formed by the polarizing reflector is here simulated for different θ angles in the xz-plane (φ=0°) and the yz-plane (φ=90°). The corresponding axial ratio versus frequency is illustrated in the FIG. 9C (xz-plane) by three curves 180, 181, 182 corresponding to an incidence angle θ of Im 0, 15 and 30°, and in the FIG. 9D (yx-plane) by three curves 184, 185, 186 corresponding to an incidence angle θ of 0°, 15° and 30°.

From these curves 180, 181, 182, 184, 185, 186 the dual-band reflecting polarizer 152 exhibits a stable axial ratio within the first and second bands 176, 178 and is particularly not affected by grating lobes in both planes. This dual-band reflecting polarizer 152 also has smaller resonant elementary cell by using a folded shape patch like here a connected E-shape patch.

It should be noted that generally a dual-band reflecting polarizer according to the invention may also use rectangular, connected T-shape, connected spiral E-shape.

Regardless of the shape of the patches used by the dual-band reflecting polarizer according to the invention, a great stability and a low sensitivity of the axial ratio to the incidence angle within the first and second bands is achieved.

Figure 10:
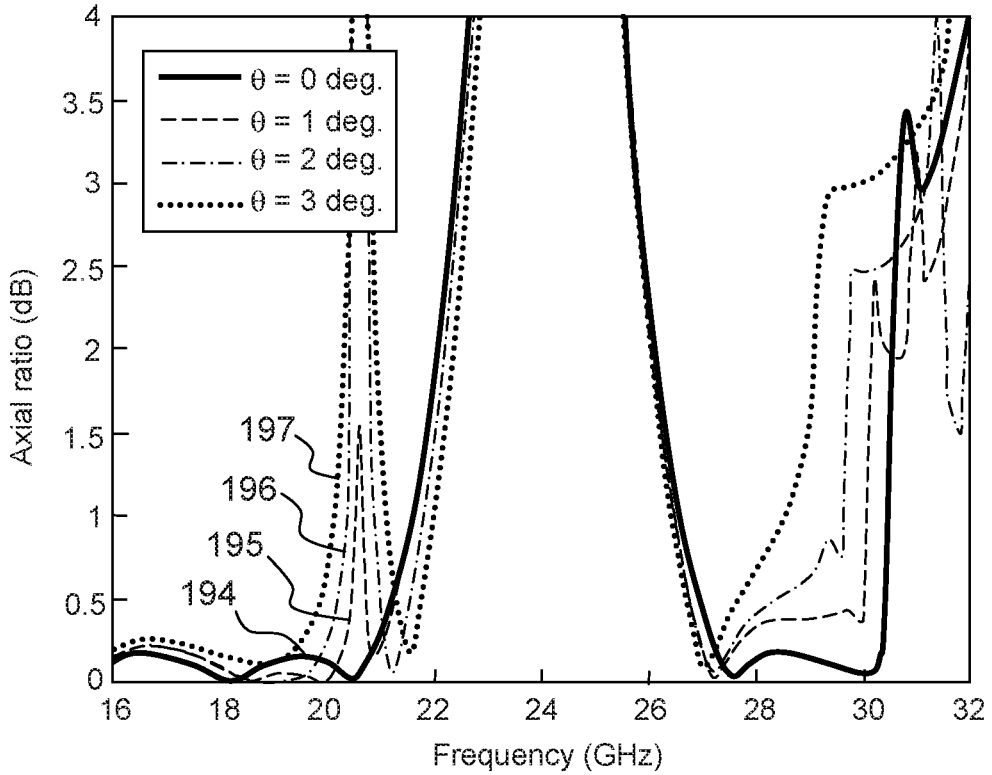
FIG.10 PRIOR ART
FIG. 10 is a view of simulated axial ratio performance at oblique incidence along xz- and yz-planes shown by a conventional flat polarizing reflector, conventionally tuned to operate in dual-band and described in the cited third document.

Conversely and as shown in the FIG. 10 described in the third cited document, a conventional dual-band reflecting polarizer exhibits a lower stability and a greater sensitivity of the axial ratio to the incidence angle within the first and second operating bands.

In the FIG. 10, the axial ratio versus frequency is illustrated by three curves 194, 195, 196, 197 corresponding to an incidence angle θ in the yz-plane of 0, 1, 2, and 3° and the synthesized conventional polarizing reflector uses a flat array of rectangular patches.

Figure 11A:
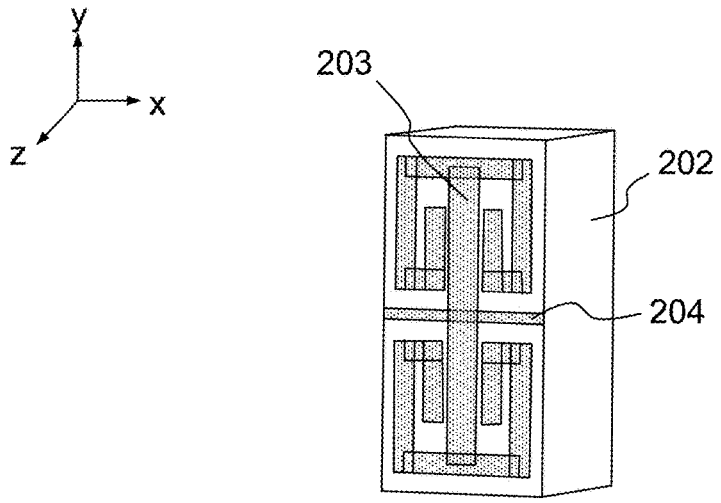
FIGS. 11A and 11B are respectively a structural view of a second variant of an elementary cell of a polarizing reflector according to the first embodiment of the invention, the shape of the patch of the elementary structure being a miniaturized connected spiral E-shape and elongated along the polarization of the TE mode and crossed centrally at a connection level by a metallic strip, and a chart of an example of the evolution of the phases versus frequency of the reflected TM resonant mode and the TE resonant mode, corresponding to an operation in dual-band and a tuning of the elementary cell according to the invention.
Figure 11B:
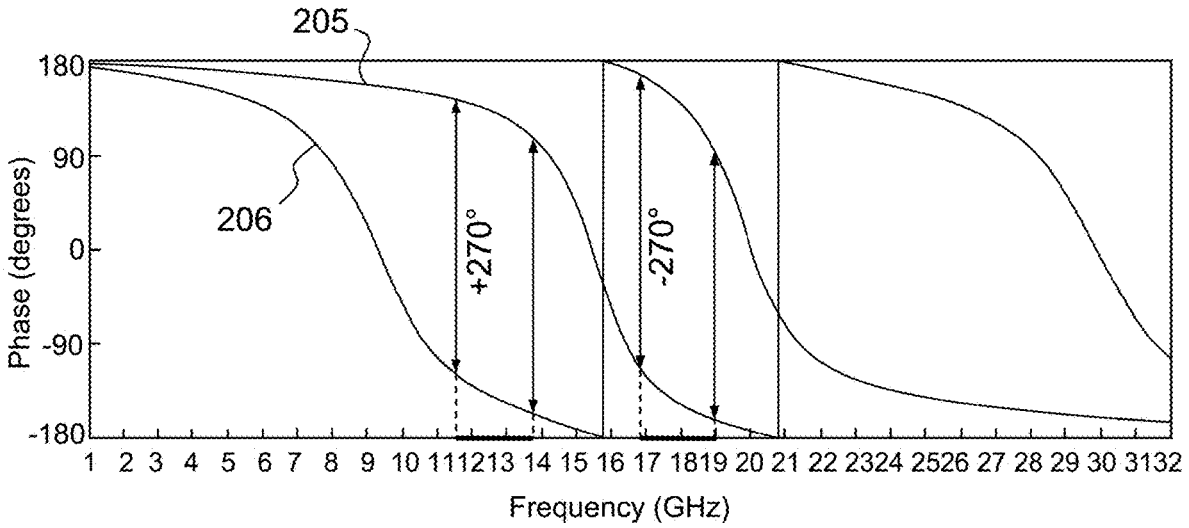

According to FIGS. 11A and 11B and a second variant, an elementary cell 202 of a polarizing reflector 2 according to the first embodiment of the invention uses a central patch 203 having a miniaturized connected spiral E-shape. The central patch 203 is elongated along the polarization of the TE mode and crossed centrally at a connection level by a metallic strip 204. The aperture array and the dipole array formed by the arrangement of the elementary cells are tuned so that the phases of the reflected TM resonant mode and the TE resonant mode evolve with frequency according to a first curve 205 and a second curve 206. This tuning is similar to the tuning carried out in the case using connected E-shape shown in the FIGS. 9A-9B. This tuning corresponds also to an operation in dual-band.

Figure 12A:
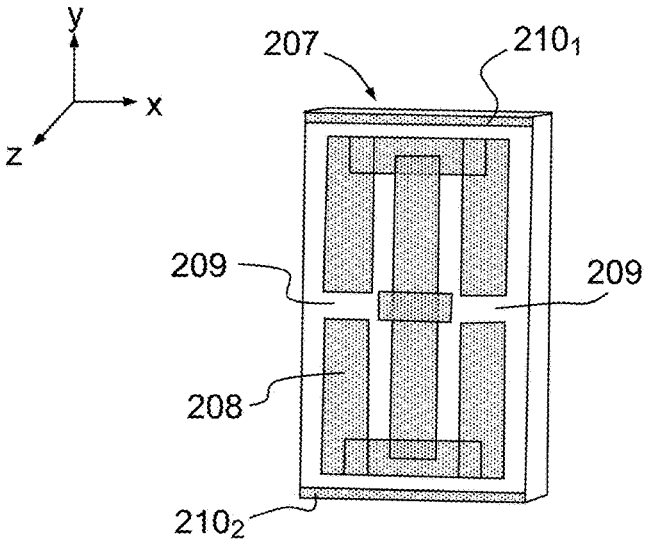
FIGS. 12A and 12B are respectively a structural view of an elementary cell of a variant of the polarizing reflector according to the first embodiment of the invention, the shape of the patch of the elementary structure being a miniaturized connected E-shape and elongated along the polarization of the TE mode and lined on each side with a continuous metallic strip, and a chart of an example of the evolution of the phases versus frequency of the reflected TM resonant mode and the TE resonant mode, corresponding to an operation in dual-band and a tuning of the elementary cell according to the invention.
Figure 12B:
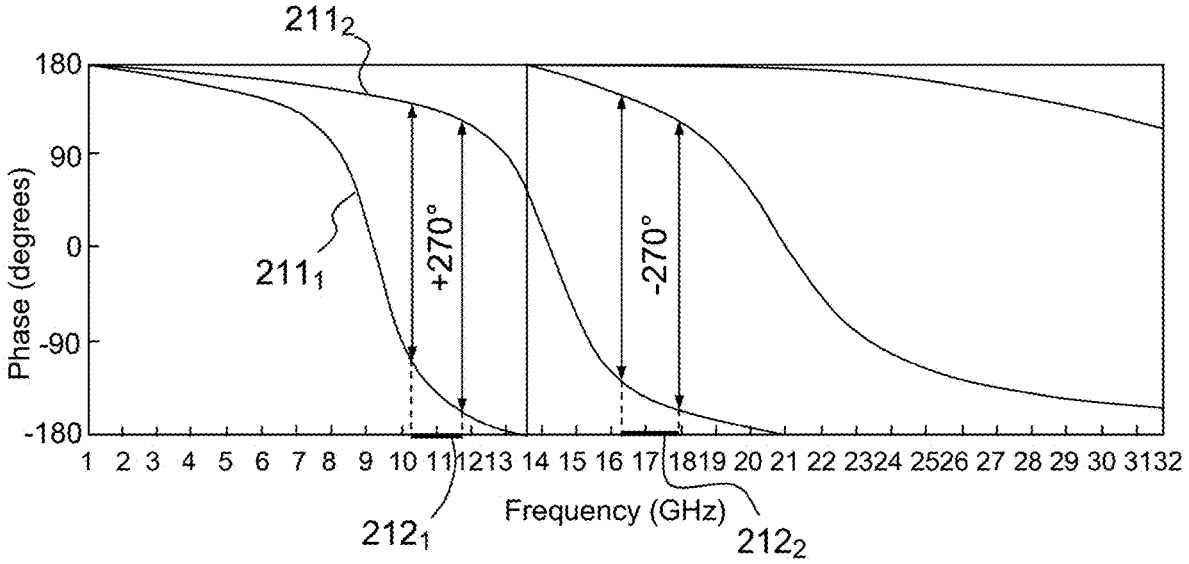

According to FIGS. 12A and 12B, an elementary cell 207 of a polarizing reflector 2 according to the variant of the first embodiment of the invention uses a central patch 208 having a miniaturized connected E-shape like the central patch of FIG. 9. The central patch 208 is elongated along the polarization of the TE mode and disconnected from the other patches sharing the same row by a lateral isolating gap 209. The central patch 208 is surrounded, above and below, or lined by two separate metallic strips or grids $\mathbf{210}_1$, $\mathbf{210}_2$ that fully extend along the x axis and which are not connected to the said central patch 208.

The aperture array and the dipole array formed by the arrangement of the elementary cells 207 are tuned so that the phases of the reflected TM resonant mode and the TE resonant mode evolve with frequency according to a first curve $\mathbf{211}_1$ and a second curve $\mathbf{211}_2$.

With such a tuning a circular polarization with low axial ratio and a first handedness can be achieved over a first frequency band $\mathbf{212}_1$ that corresponds to the end of the resonance of the dipole mode and to the beginning of the resonance of the aperture mode. Over this first frequency band, the phase difference between the reflection coefficients for the TE and TM waves are equal to +270°.

A circular polarization with opposite handedness and low axial ratio can be achieved over a second frequency band $\mathbf{212}_2$ that corresponds to the end of the aperture mode and to the beginning of the resonance of the higher order dipole mode. Over the second frequency band $\mathbf{212}_2$, the phase difference between the reflection coefficients for the TE and TM waves is equal −270°. This tuning corresponds to an operation in dual-band depending on the selected second operating frequency band.

Figure 13:
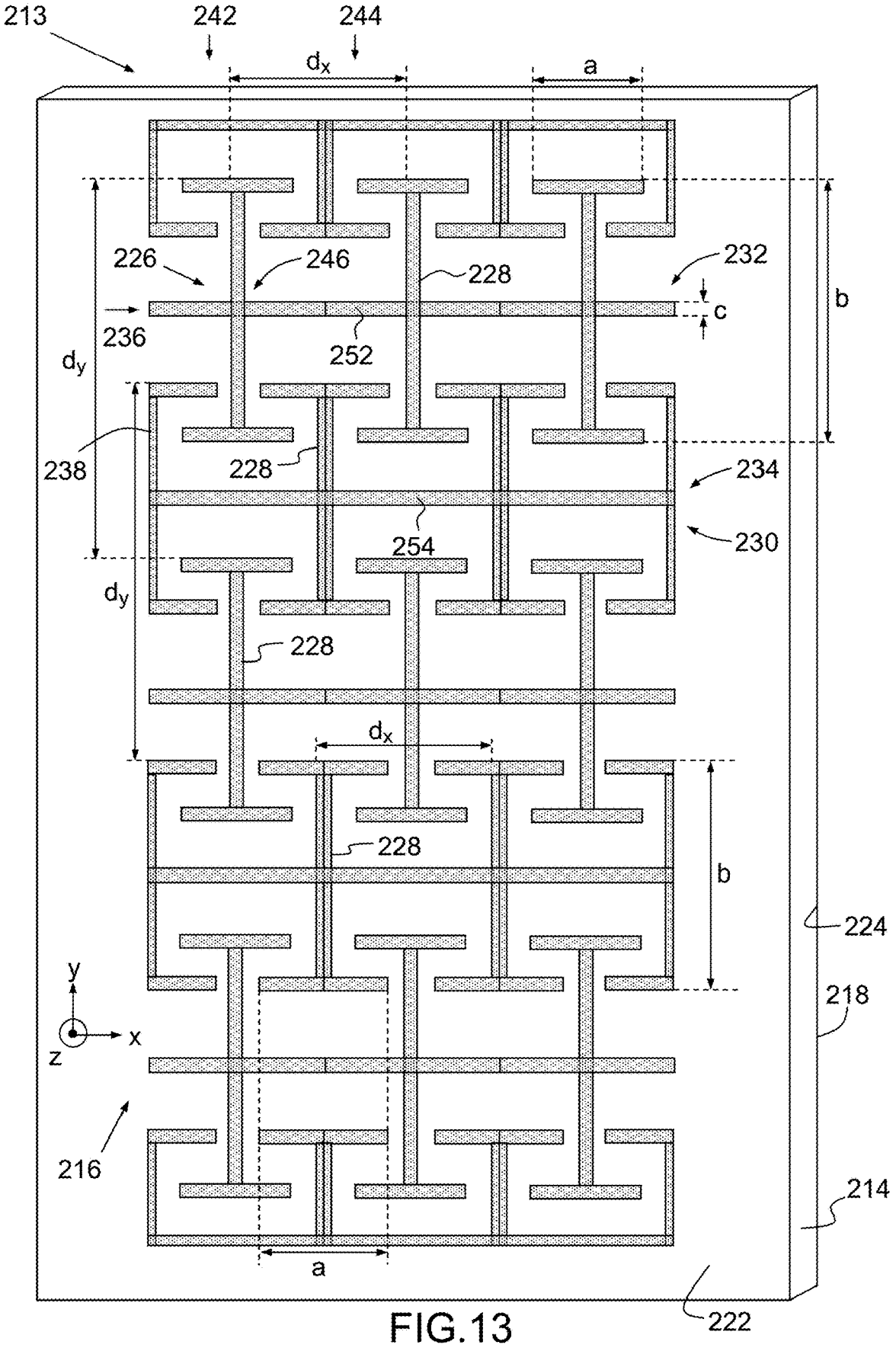
FIG. 13 is a front view of polarizing reflector according to a second embodiment of the invention wherein a flat patch array comprises at least two lattices of patches, here two lattices, interleaved between each other, here the patch shape of the used patches being a connected T-shape.

According to FIG. 13 and a second embodiment of the invention, a polarizing reflector 213 suited to broadband satellite applications is configured for converting a same linear polarization into a given circular polarization handedness over one frequency band, or into a given circular polarization handedness over a first frequency band and into the orthogonal handedness over a second frequency band.

The polarizing reflector 213 comprises a flat dielectric substrate 214, a patch array layer 216 and a ground layer 218.

The flat dielectric substrate 214 is delimited between a first surface 222 and a second surface 224, having a thickness h and a dielectric permittivity $\varepsilon_r$.

The patch array layer 216 is formed by a first bi-dimensionally periodic lattice 226 of thin metallic patches 228 and a second bi-dimensionally periodic lattice 230 of thin metallic patches 228, both laid on the first surface 222 of the substrate 214.

The first and second periodic lattices 226, 230 having each a first set 232, 234 of patch rows 236, 238 oriented along a same first direction x with a same periodicity $d_x$ and a second set 242, 244 of patch columns 246, 248 oriented along a same second direction y with a same second periodicity $d_y$.

The ground layer 218 formed by a plain metallic layer on the second surface 224, located below the patch array layer 216, and the dielectric substrate 214 separates the patch array layer 216 and the ground layer 218.

All the patches 228 have a same shape elongated along the second direction y and form electric dipoles when excited along the second direction y.

Here, the metallic patches 228 are rectangular and have each a same length b, a same width a and a same thickness t.

The thin polarizing reflector is characterized by the following features.

For each row 236, 238 of the first lattice 226 and the second lattice 230 the patches 228 of the said rows 236, 238 are interconnected by an elongated metallic strip 252, 254 oriented along the first direction x and having a width c.

The first and the second lattices 226, 230 of the patches 228 including the elongated metallic strips 242 are geometrically interleaved while being spatially separate.

The geometry of the patch array layer 216, the thickness h and the dielectric permittivity $\varepsilon_r$ of the substrate 214, and the width c of the elongated metallic strips 242 are tuned so that the patch array 216 induces a fundamental aperture mode and a complementary fundamental dipolar mode along two orthogonal TE and TM polarizations within the single frequency band or within the first frequency band and the second frequency band when operating in dual wide band when operating in a single wide band or within the first frequency band and the second frequency band when operating in dual wide band.

The differential reflection phase between the two fundamental modes over the single or the first and second frequency bands is equal to ±90° or to an odd integer multiple of ±90°.

Figure 14A:
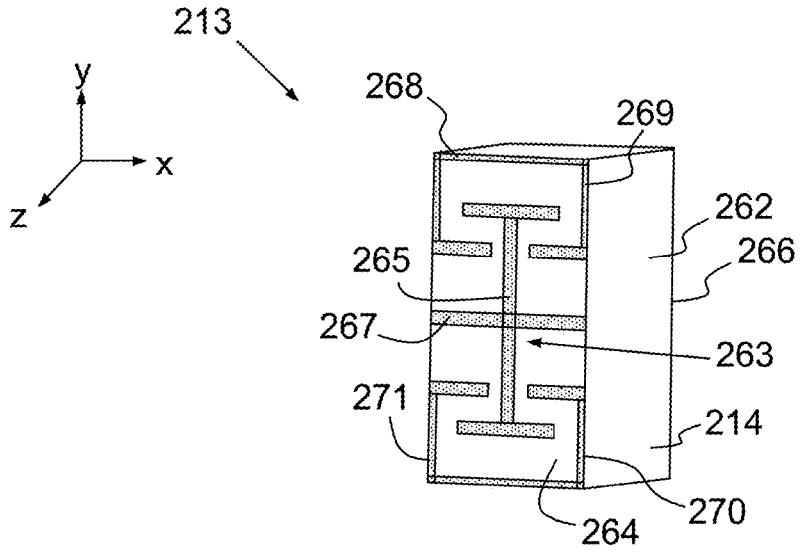
FIGS. 14A and 14B are respectively (a) a structural view of an exemplary elementary cell of the polarizing reflector according to the second embodiment of the invention and the FIG. 13, one T-connected patch of a first patch array being integrally included in the elementary cell and four T-connected patch quarters of a second patch array surrounding the patch integrally included in the elementary cell, all the patches partially or fully included in the elementary cell being elongated along the polarization of the TE mode and crossed centrally at their respective connection level by a metallic strip, and (b) a chart of an example of the evolution of the phases versus frequency of the reflected TM resonant mode and the TE resonant mode, corresponding to an operation in dual-band and a tuning of the elementary cell according to the invention.

According to FIG. 14A, an elementary cell 262 of the polarizing reflector 212 of the FIG. 13 is illustrated. The elementary cell 262 is a basic generic structural element that forms the polarizing reflector 212 when repeated periodically over the surface of the said polarizing reflector 212. In other words the polarizing reflector 212 is made up with a set of elementary cells 262 adjoining each other and paving a given surface, here rectangular, of the polarizing reflector 212.

The elementary cell 262 is a piece of the dielectric substrate 214, having a parallelepiped shape, covered on a central area 263 of a first face 264 of the parallelepiped oriented along the z axis by one connected T-shape metal patch 265 elongated along the y axis, and covered plainly on a second face 266 of the parallelepiped, opposite to the first face 264, by a metallic ground layer (not shown). The elementary cell 262 also includes on its first face 264 an elementary crossing strip 267, being part of a metallic strip elongated along the y axis, crossing the middle of the elongated patch 265 and extending fully along the x axis. The central connected T-shape metal patch 265 and its elementary crossing strip 267 belong to the first lattice.

The dielectric substrate 214 of the elementary cell 252 is also covered on each corner of the first face 264 of the elementary cell 262 by four metallic patterns 268, 269, 270, 271, belonging to four T-shape patches of the second lattice and surrounding globally the central connected T-shape metal patch 265 and its elementary crossing strip 267. The metallic patterns 268, 269, 270, 271 correspond respectively to a bottom right, a bottom left, a top left, a top right of a different T-shape patch and its elementary crossing strip and respectively covers the top left corner, the top right corner, the bottom right, the bottom left corner of the elementary cell 262.

The dimensions of the parallelepiped are respectively $d_x$, $d_y$, h along the x, y, z axis while the planar dimensions of the elongated patch 265 are respectively a, b along the x, y axis and the thickness of the elongated patch 265, the elementary crossing strip 267 and the ground layer is equal to the thickness t.

By using such elementary cells 262, the dual-band polarising reflecting surface or dual-band polarizing reflector 212 can be synthesized for operating in dual-band by tuning the geometry of the dipole array formed by the patches 260 and the width c of the elongated metallic strips so that a first resonance frequency of the dipolar mode and a first resonance frequency of the aperture mode, higher than first resonance frequency of the dipole mode, surround the first given frequency wide band of the dual operating band, and the first resonance frequency of the aperture mode is located before the second frequency wide band of the dual operating band.

More generally, the geometry of the dipole patch array, the thickness t and the dielectric permittivity of the substrate, and the width c of the elongated metallic strips are tuned so that a first resonance frequency of the dipolar mode and a first resonance frequency of the aperture mode, higher than first resonance frequency of the dipolar mode, surround the first frequency band of the dual operating wide band, and the first resonance frequency of the aperture mode is located before the second frequency band of the dual operating band.

Figure 14B:
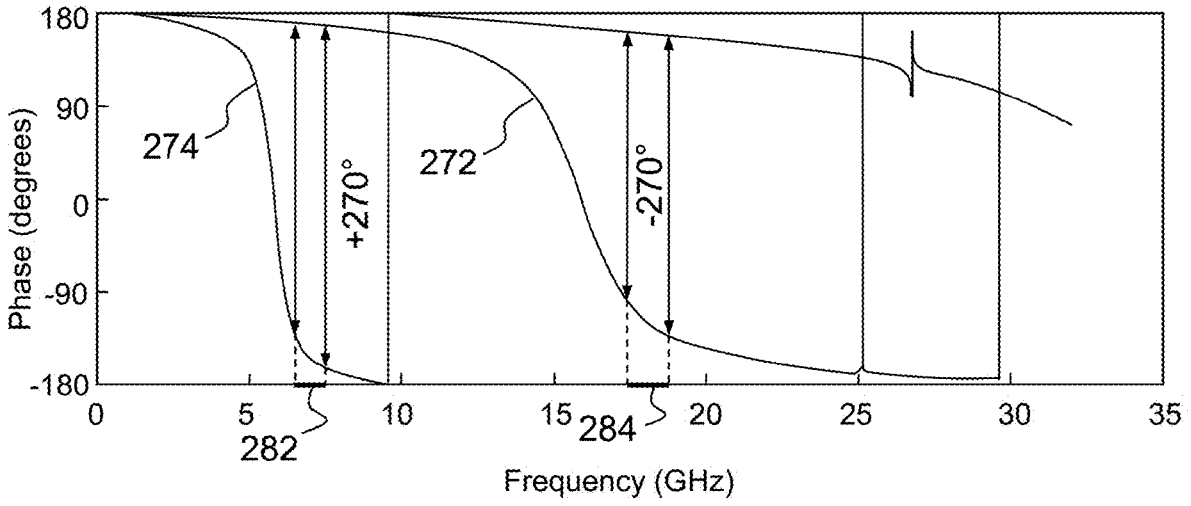

As an example of tuning and as shown in FIG. 14B, assuming a time-harmonic dependence given by $e^{j\omega t}$ and defining handedness from the point of view of the source, a differential reflection phase of +270° between TE and TM waves, i.e., $\varphi^{TM}-\varphi^{TE}=\pi/2$ where $\varphi^{TM,TE}$ is the phase of the complex phasor representing the reflected TM, TE field, will convert an incident linearly polarized electric field at +45° with respect to the x-axis into a field with right-hand circular polarization (RHCP) while an incident linearly polarized electric field at −45° with respect to the x-axis will be converted into a field with left hand polarization (LHCP). If the differential reflection phase between the TE and TM waves is instead −270°, the handedness of the reflected circularly polarized fields is inverted. In the FIG. 9B the evolution of the phase of the complex phasor representing the reflecting TM field and the evolution of the phase of the complex phasor representing the reflecting TE field are respectively illustrated by a first curve 272 and a second curve 274.

It should be noted that as variants other tunings can be implemented and generally the geometry of the patch array, the thickness h and the dielectric permittivity $\varepsilon_r$ of the substrate, and the width c of the elongated metallic strips are tuned so that the differential reflection phase between the two fundamental modes over the single or the first and second frequency bands are equal respectively to +90° and −90°.

As shown by the FIGS. 14A and 14B the patch array layer according the invention, as comprising both the interleaved bi-periodic first and second dipole connected T-shape patch lattices and crossing elongated strips, combines on the same surface, a dipole array and an aperture array. The patch array layer of the polarizing reflector has been synthesized so that it exhibits respectively a +270° and −270° phase difference between the reflection modes in 7.5 and 18 GHz sub-bands, referenced respectively by the numeral references 282 and 284. An aperture mode is induced between the grids formed by the rows of patches crossed by their corresponding elongated strips, and a dipole mode is excited in the folded dipole formed by the connected T-shape of the dipole. The largest dimension of the patch element is only $0.52\lambda_g$ at the highest frequency of the band, i.e. more than three time smaller that the size of patches used in the conventional polarizing reflector.

By using such interleaved lattices of patches, the elementary cell is smaller and the dual-band reflecting polarizer thus obtained is not affected by grating lobes in both incident planes and exhibits a stable axial ratio within the first and second bands 282, 284.

Generally a dual-band reflecting polarizer according to the second embodiment of the invention may also use patches having a rectangular shape, a connected E-shape and a connected spiral E-shape.

Regardless of the shape of the patches used by the dual-band reflecting polarizer according the invention, a greater stability and a lower sensitivity of the axial ratio to the incidence angle within the first and second bands is achieved compared to the conventional polarizing reflector.

Figure 15A:
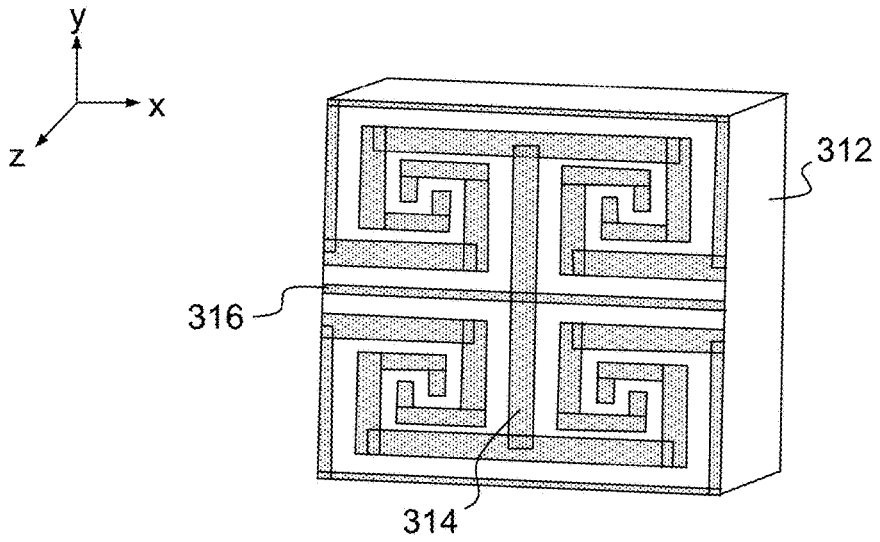
FIGS. 15A and 15B are respectively (a) a structural view of a variant elementary cell of the polarizing reflector according to the second embodiment of the invention and the FIG. 12, wherein the shape of each patch is a miniaturized connected spiral E-shape, and (b) a chart of an example of the evolution of the phases versus frequency of the reflected TM resonant mode and the TE resonant mode, corresponding to an operation in dual-band and a tuning of the second variant elementary cell according to the invention.
Figure 15B:
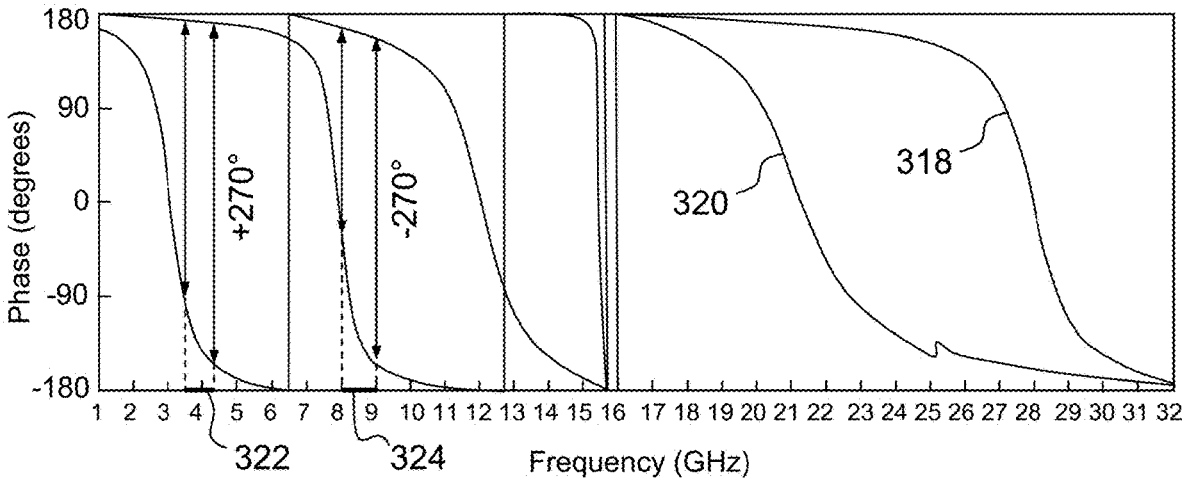

According to the FIGS. 15A and 15B, a variant of an elementary cell 312 of a polarizing reflector according to the second embodiment of the invention uses a central patch 314 having a miniaturized connected spiral E-shape. The central patch 314 is elongated along the polarization of the TE mode and crossed centrally at a connection level by a metallic strip 316. The aperture array and the dipole array formed by the arrangement of the elementary cells 312 are tuned so that the phases of the reflected TM resonant mode and the TE resonant mode evolve with frequency according to a first curve 318 and a second curve 320. This tuning corresponds to an operation in a dual band with a first handedness circular polarization in a first band 322 at 4.5 GHz and a second handedness circular polarization, opposite to the first one in a second band 324 at 8.5 GHz.

Figure 16:
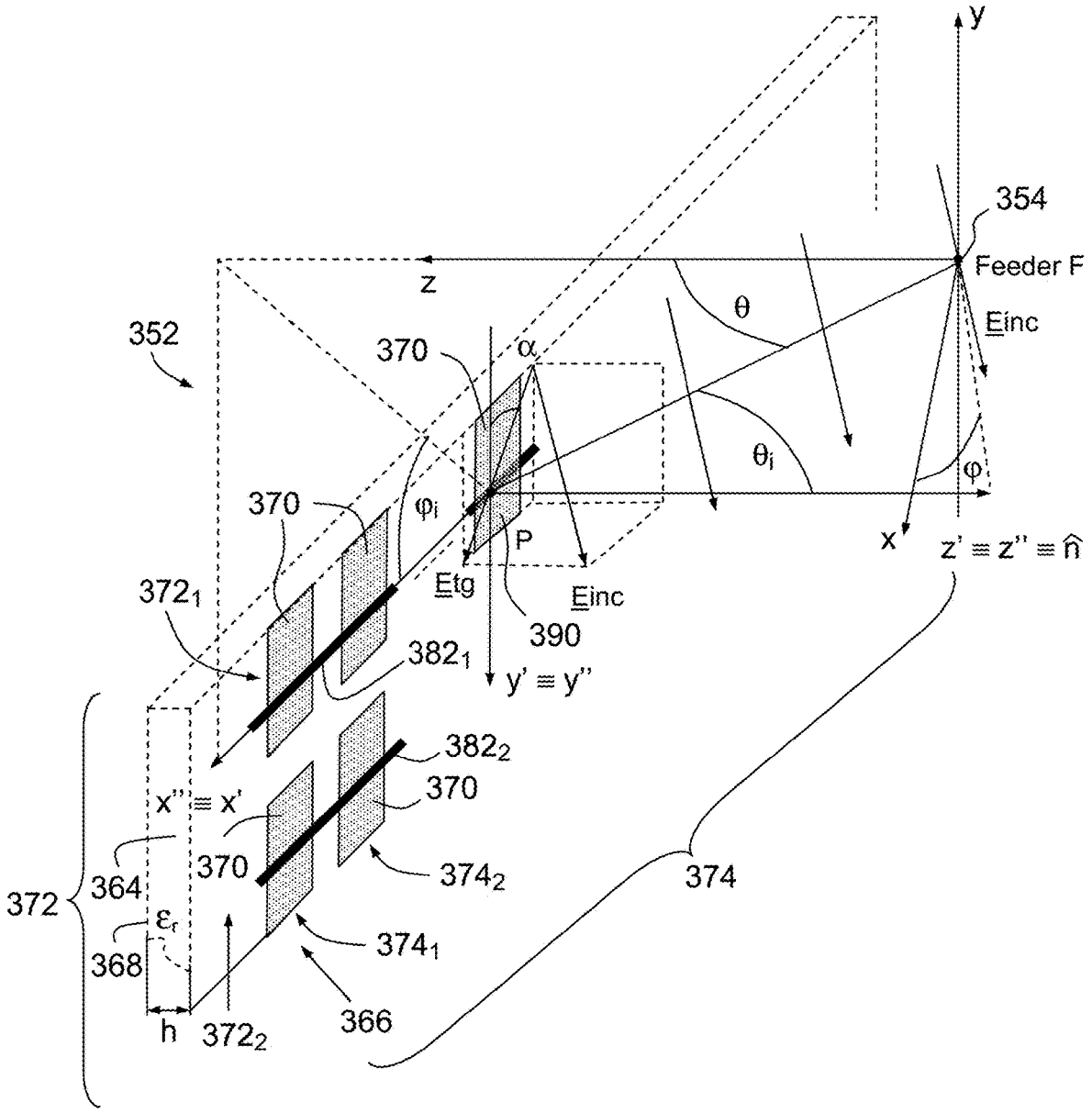
FIG. 16 is a view of the basic principle that permits to determine a flat profile polarizing reflector according to a third embodiment in a general case of illumination (normal or oblique incidence) by a radiation source.

According to the FIG. 16 and a third embodiment of the polarizing reflector, a flat polarizing reflector 352 for a broadband antenna is locally illuminated at normal or oblique incidence by an electromagnetic source 354 (or feeder) having a predetermined radiation pattern to the flat polarizing reflector.

The flat polarizing reflector 352 is configured for converting locally a linear polarization $\underline{E}$inc into a given local circular polarization handedness over one frequency band when operating in a single wideband at a local normal or oblique incidence illuminated by a local plane wave originated from a predetermined radiation source pattern, or into a first local circular polarization handedness over a first frequency band and into a second local polarization handedness over a second frequency, the first and the second local circular polarization handedness being substantially equal or orthogonal when operating in dual-band at normal or oblique incidence illuminated by a local plane wave originated from a predetermined radiation source pattern.

The flat polarizing reflector 352 comprises a flat profile dielectric substrate 364, a patch array layer 366, a ground layer 368.

The flat profile dielectric substrate 364 is delimited between a first flat surface with a first flat profile and a second flat surface with a second flat profile, and has a thickness h and a dielectric permittivity $\varepsilon_r$.

The patch array layer 366 is formed by a bi-dimensionally flat lattice of thin metallic patches 370 on the first surface of the substrate, the flat lattice having a first set 372 of linear patch rows $\mathbf{372}_1$, $\mathbf{372}_2$ and a second set 374 of linear patch columns $\mathbf{374}_1$, $\mathbf{374}_2$.

The ground layer 368 is formed by a plain metallic layer on the second surface, located below the patch array layer 366.

The substrate 364 separates the patch array layer 366 and the ground layer 368, and all the patches having a same elongated shape and form electric dipoles when excited along their own direction of elongation.

For each patch row $\mathbf{372}_1$, $\mathbf{372}_2$ the patches 370 of the said patch row are crossed by an elongated metallic strip $\mathbf{382}_1$, $\mathbf{382}_2$ having a reference width c.

In a variant, the patches of a same patch row are lined by two elongated metallic strips having a reference width c.

The geometry of the patch array 366, the thickness h and the dielectric permittivity of the substrate 364, and the geometry of the elongated metallic strips $\mathbf{382}_1$, $\mathbf{382}_2$ are tuned so that each phasing cell, made of an elongated electric dipole 370 and a portion of the elongated metallic strip crossing the said elongated electric dipole or made of an elongated electric dipole and a portion of the two elongated metallic strip lining the said elongated electric dipole, and laid on the grounded flat substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands being equal to ±90° or to an odd integer multiple of ±90°.

For each phasing cell, while keeping unchanged the local longitudinal direction of the portion of the single crossing elongated metallic strip or the two lining elongated metallic strips, the elongated electric dipole is turned about the local normal to the first surface at the location of the phasing cell by a tuning polarization oriented angle A so that the corresponding axial ratio of the phasing cell is a minimum.

The tuning polarization oriented angle A is expressed by the equation:

$$A=k\cdot A0$$

A0 designates a reference tuning polarization oriented angle to turn only the electric dipole about the local normal so that the polarization angle $\alpha$ separating the local elongation direction of the turned electric dipole included in the local tangent plane to the first surface at the location of the phasing cell and the tangential component of the local incident electrical field in the local tangent plane is substantially equal to a same value equal to +45° or 45°.

k designates a positive real number equal or higher than 1 that depends on the level of the patch row the phasing cell belongs to and that minimizes the axial ratio of the phasing cell.

As an example and considering a phasing cell 390 located at a point P, the electrical incident field $\underline{E}$inc illuminated at the point P has a tangential component $\underline{E}$tg included in the local tangent plane x"y". The electrical incident field $\underline{E}$inc at the point P is defined in a local frame x"y"z" by two incidence angles $\theta_i$, $\varphi_i$, The radiated field by the source F is defined in a source frame by the radiation angles $\theta$, $\varphi$. The polarization angle depends on the radiation angles $\theta$, $\varphi$ and the incident electrical field Einc. Here, the illustrated case of the phasing cell 390 corresponds to a specific case wherein the reference tuning polarization is null and the polarization angle is substantially equal to −45°.

Figure 17:
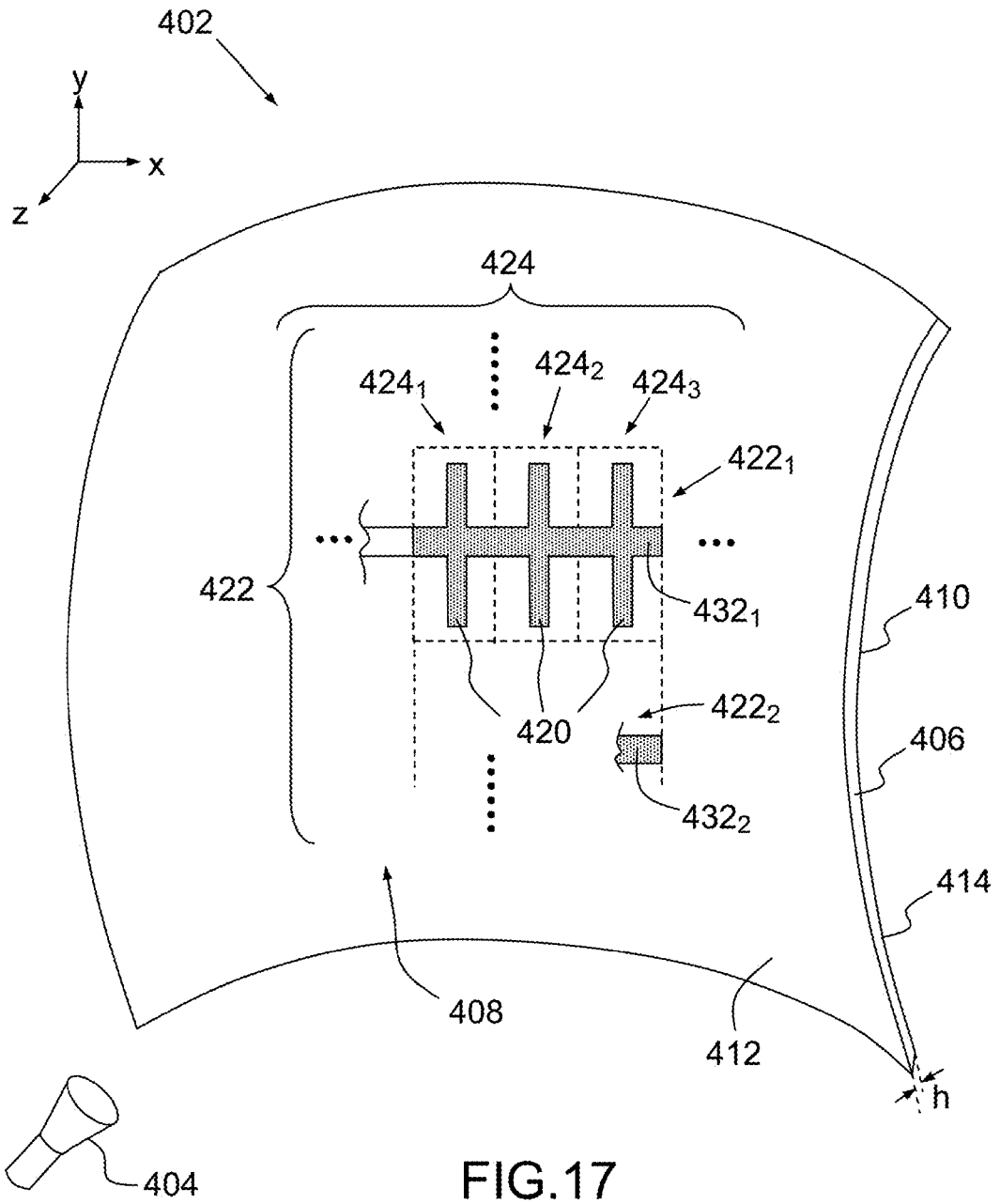
FIG. 17 is a general view of a curved profile polarizing reflector according to a fourth embodiment of the invention wherein the patch array accommodates the curved surface and is designed for spanning a wide range of angle of incidence.

According to FIG. 17 and a fourth embodiment of the invention, a curved profile polarizing reflector 402 for a broadband antenna is locally illuminated at normal or oblique incidence by an electromagnetic source 404 (or feeder) by an electromagnetic source having a predetermined radiation pattern to the curved polarizing reflector.

The curved polarizing reflector is configured for converting locally a linear polarization into a given local circular polarization handedness over one frequency band when operating in a single wideband at a local normal or oblique incidence illuminated by a local plane wave originated from a predetermined source radiation pattern, or into a first local circular polarization handedness over a first frequency band and into a second local polarization handedness over a second frequency band, the first and the second local circular polarization handedness being substantially equal or orthogonal when operating in dual-band at normal or oblique incidence illuminated by a local plane wave, The curved profile polarizing reflector 402 comprises a curved profile dielectric substrate 406, a patch array layer 408 and a ground layer 410.

The dielectric substrate 406 is delimited between a first curved surface 412 with a first curved profile and a second curved surface 414 with a second curved profile, and has a thickness h and a dielectric permittivity $\varepsilon_r$.

The patch array layer 408 is formed by a bi-dimensionally curved lattice of thin metallic patches 420 on the first curved surface 412 of the substrate, the curved lattice having a first set 422 of curvilinear patch rows $\mathbf{422}_1$, $\mathbf{422}_2$ and a second set 424 of curvilinear patch columns $\mathbf{424}_1$, $\mathbf{424}_2$, $\mathbf{424}_3$.

The ground layer 410 is formed by a plain metallic layer on the second surface 414, located below the patch array layer 408, and the substrate 406 separates the patch array layer 408 and the ground layer 410.

All the patches 420 have a same substantially elongated shape and form electric dipoles when excited along their own direction of elongation.

As a variant, the patch array may be etched on a thin dielectric substrate, the ground layer may be made on another thin substrate, these two thin substrates being separated by a spacer honeycomb and stiffening layers. This assembly results in a composite panel polarizing reflector.

The polarizing reflector is characterized by the following features.

For each curvilinear patch row $\mathbf{422}_1$, $\mathbf{422}_2$, the patches 420 of the said curvilinear patch row $\mathbf{422}_1$, $\mathbf{422}_2$ are crossed by an elongated metallic strip $\mathbf{432}_1$, $\mathbf{432}_2$ having a reference width c.

As a variant, for each curvilinear patch row the patches of the said curvilinear patch row are lined by two elongated metallic strips having a reference width c.

The geometry of the patch array, the thickness h and the dielectric permittivity of the substrate, and the geometry of the elongated metallic strips are tuned so that each phasing cell, made of an elongated electric dipole and a portion of the elongated metallic strip crossing the said elongated electric dipole or made of an elongated electric dipole and a portion of the two elongated metallic strip the said elongated electric dipole, laid on the grounded curved substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual band.

The differential reflection phase between the two fundamental modes over the single or the first and second frequency bands being equal to ±90° or to an odd integer multiple of ±90°.

For each phasing cell, while keeping unchanged the local longitudinal direction of the portion of the single crossing elongated metallic strip or the two lining elongated metallic strips, the elongated electric dipole is turned about the local normal to the first surface at the location of the phasing cell by a tuning polarization oriented angle A so that the corresponding axial ratio of the phasing cell is a minimum.

The tuning polarization oriented angle A is expressed by the equation:

$$A=k\cdot A0$$

A0 designates a reference tuning polarization oriented angle to turn only the electric dipole about the local normal so that the polarization angle $\alpha$ separating the local elongation direction of the turned electric dipole included in the local tangent plane to the first surface at the location of the phasing cell and the tangential component of the local incident electrical field in the local tangent plane is substantially equal to a same value equal to +45° or 45°.

k designates a positive real number equal or higher than 1 that depends on the level of the patch row the phasing cell belongs to and that minimizes the axial ratio of the phasing cell.

Figure 18:
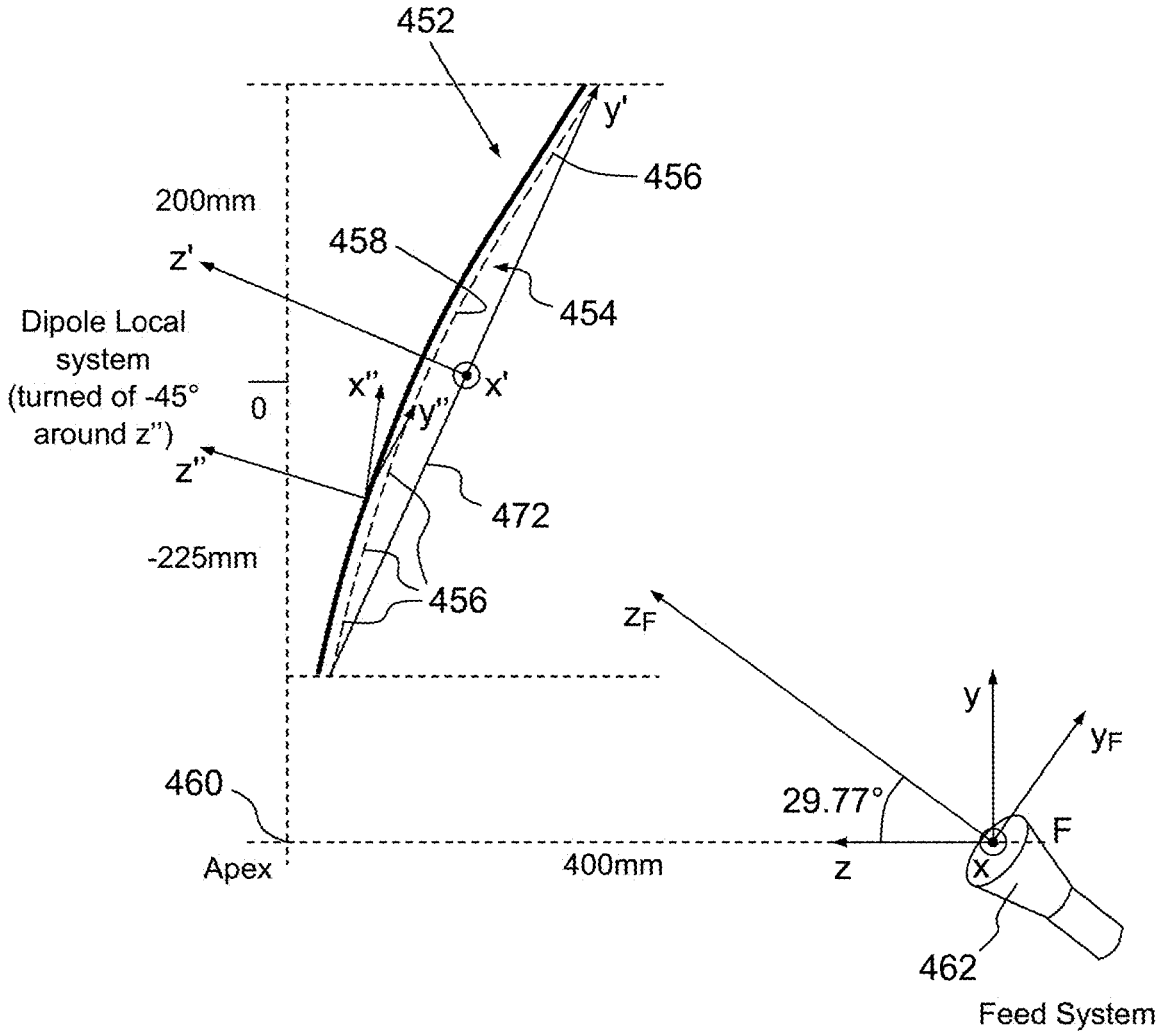
FIG. 18 is a section view of a curved profile polarizing reflector of FIG. 17 for a particular configuration wherein the reflector shape is a portion of a parabolic cylinder and an offset source.
Figure 19:
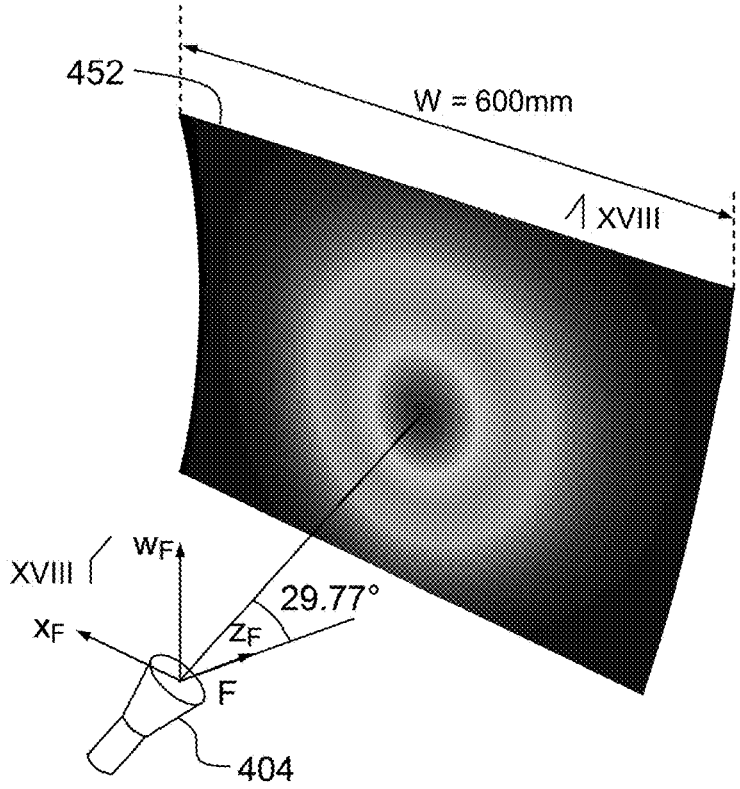
FIG. 19 is a view of the source illumination pattern of the curved polarizing reflector of FIG. 18.

According the FIGS. 18 and 19, a particular configuration of the polarizing reflector of FIG. 17, the shape of the polarizing reflector 452 is a portion of a parabolic cylinder.

A curved patch array 454 of rectangular metallic patches 456 is formed on a first surface 458 that is a portion of a parabolic cylinder, the parabolic cylinder having an apex line 460 and the portion having a width equal to 600 mm.

The polarizing reflector 452 is illuminated by an offset radiation source 462 located at the focal point of the parabola section and at the middle of the surface portion along the cylinder longitudinal direction x. The offset of the radiation source by a pointing angle departing from the apex pointing direction equal here to 29.77°.

According to the FIG. 19, the illumination radiation of the radiation source observed on the polarizing reflector is illustrated.

According to FIG. 18, each row of patches is extended along the cylinder longitudinal direction x (or x', x"), only one metallic patch per row being shown on the section view. Here, it is assumed that each rectangular patch has an elongated shape along a local elongated direction y" that is included in a local tangent plane at the curved surface and orthogonal to the cylinder longitudinal direction x".

The curved patch array 454 corresponds to a virtual flat profile reference patch array 472 formed by a bi-dimensionally reference periodic lattice of thin virtual reference metallic patches, the reference periodic lattice having a first reference set of patch rows oriented along a first reference direction x' with a periodicity $d_x$, and a second reference set of patch columns oriented along a second reference direction y' with a second periodicity $d_y$.

For each virtual reference patch row, the virtual reference patches of the said virtual patch row are crossed by a virtual reference elongated metallic strip generally oriented along the first reference direction x' and having a reference width c.

In a variant, the virtual reference patches of the said virtual reference patch row are lined by two virtual reference elongated metallic strips generally oriented along the first reference direction x' and having a reference width c.

To each phasing cell of the curved polarizing reflector 452 corresponds a virtual flat reference phasing cell of the virtual flat reference patch array 472, made of a virtual elongated electric dipole and a portion of the virtual elongated metallic strip crossing the said virtual elongated electric dipole (or in the variant case) made of a virtual elongated electric dipole and a portion of the two virtual elongated metallic strips lining the said virtual elongated electric dipole, laid on a virtual grounded flat substrate having a permittivity $\varepsilon_r$ and a thickness h, the elongation direction of the virtual elongated electric dipole being rotated from a predetermined angle to the second reference direction y' so that the said phasing cell of the curved polarizing reflector 452 induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands being equal to ±90° or to an odd integer multiple of ±90°.

Here, the curved patch array 454 is a projection of the virtual flat profile reference patch array 472 generally located closest to the first surface 458 of the substrate.

As a variant, the virtual flat profile reference path array is the curved patch array developed on a flat surface. This variant is also applicable when the curved surface is a portion of a circular cylinder or an elliptic cylinder or a hyperbolic cylinder (to be confirmed by the inventors).

Figure 20:
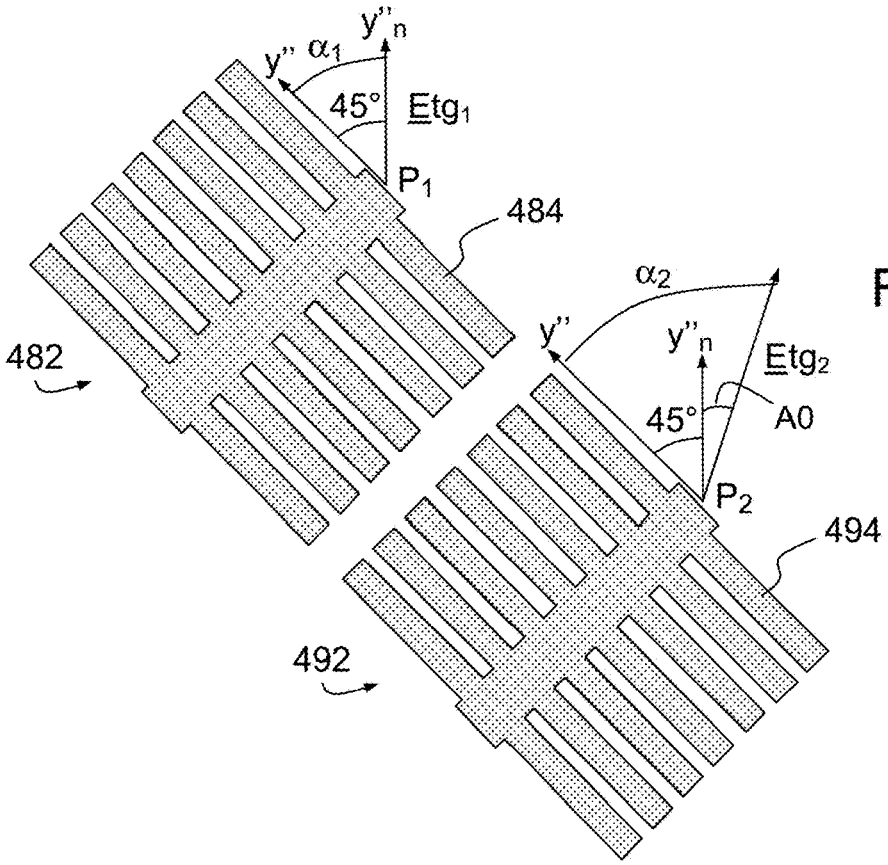
FIG. 20 is a comparative view of a reference local tuning polarization angle A0 to be compensated between a first configuration wherein the reference local tuning polarization angle A0 is null and a second configuration wherein the reference local tuning polarization angle A0 is not null, the reference local tuning polarization angle A0 being an angular difference between the local incident electrical field included in the plane tangent to the curved surface and a local target reference direction, the local target direction being phased to the elongation direction in the same plane with −45°.

As shown in the FIG. 20, a first configuration of a first patch row 482 not yet tuned of the curved polarizing 452 exhibits at a point P1 of the curved surface a first metallic patch 484 that forms a first electric dipole and that has a first polarizing angle $\alpha 1$ equal to +45°+A0 with A0 a null tuning angle (which corresponds to an illumination at normal incidence to a local flat plane). Thus this first metallic does not require to be tuned.

A second configuration of a second patch row 492 not yet tuned of the curved surface 452 plane, exhibits at a point P2 of the surface a second metallic patch 494 that forms a second electric dipole and that has a second polarizing angle $\alpha 2$ equal to +45°+A0 with A0 here a non zero reference tuning polarization angle. The tuning of the second metallic patch 494 consists in rotating the said patch 494 by the k·A0 angular value in order to get an angularly tuned patch that minimizes the axial ratio of the phasing cell.

Figure 21:
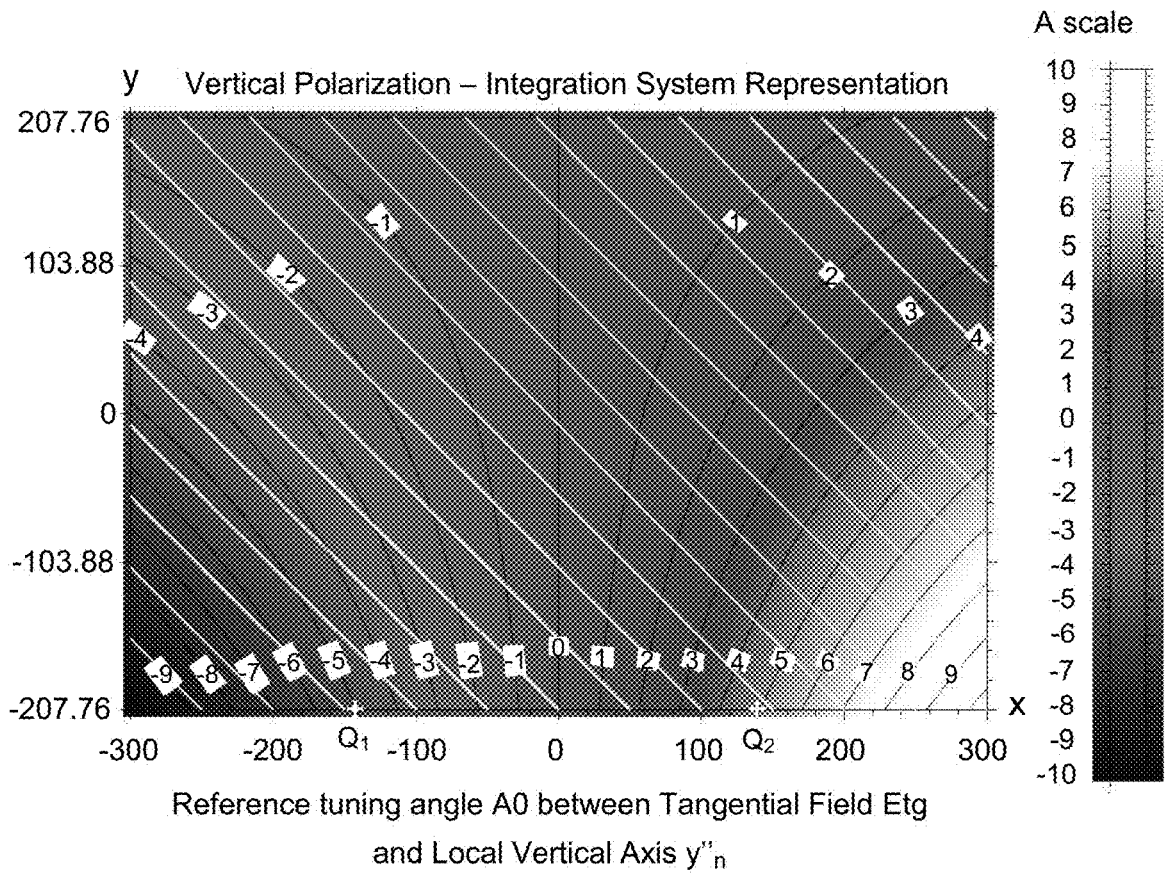
FIG. 21 is a chart of the reference local tuning polarization angle A0 versus the location of the electric dipole over the curved patch array.

According to the FIG. 21, a chart of the reference tuning polarization angle A0, as the angular difference between the tangential field Etg and the local vertical axis yn", versus the location of an electric dipole over the curved flat patch array 452 of FIG. 18 in the frame xy is illustrated.

The reference tuning polarization angle A0 at a first point Q1(y=−207.76 mm and x=−150 mm) and a second point Q2 (y=−207.76 mm and x=150 mm) of the first curved surface is respectively equal to −5.30° and +5.30°.

Figure 22:
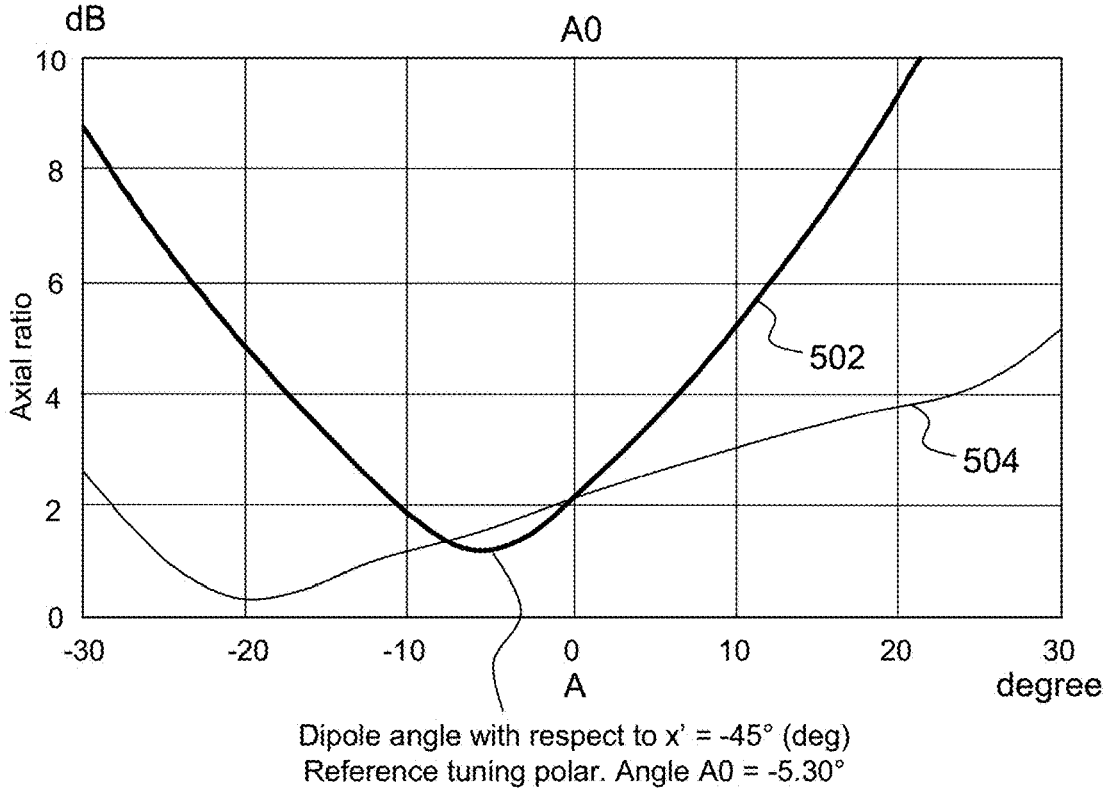
FIG. 22 is a comparative view of the evolution versus the reference tuning polarization angle A0 of the simulated axial ratio exhibited by a theoretical reference phasing cell located at a first point Q1 (y=−207.76 mm and x=−150 mm) of the curved polarizing reflector of FIG. 18 and the evolution versus the reference tuning polarization angle A of the simulated axial ratio exhibited by an actual phasing cell located at the same first point Q1.

As shown in the FIG. 22, a first curve 502 illustrates the simulated evolution of the axial ratio versus the reference tuning angle A0 experienced by a theoretical reference phasing cell located at the first point Q1 (y=−207.76 mm and x=−150 mm) of the curved polarizing reflector illustrated in FIG. 18. In this theoretical configuration the respective polarization orientations of the electrical dipole and the portion of crossing metallic strip are both rotated by the same reference tuning angle A0, here equal to −5.30° according to FIG. 21. This tuning permits to keep a phasing angle between the tangential incident field Etg and the direction of elongation of the electrical dipole equal to −45°. This tuning shows a minimum of the axial ratio of the reference phasing cell equal to 1.3 dB for A0=−5.30°.

A second curve 504 is the simulated evolution of the axial ratio versus the tuning angle A experienced by an actual phasing cell located at the point Q1 in an actual configuration. While the orientation of the portion of the crossing metallic strip is kept unchanged, only the polarization orientation of the electrical dipole is rotated by the tuning angle A in the tangent plane so that the axial ratio of the phasing cell is minimized. Here a minimum of the axial ratio equal to 0.3 dB is observed at a value of the tuning polarization angle A equal to −20 degree. When expressing A as A=k·A0, the optimizing k value is equal to 3.77.

In spite of a good axial ratio performance at the minimum of the first curve 502 the implementation of the corresponding theoretical reference phasing cell is not feasible.

Conversely, the actual phasing cell corresponding to the second curve 504 can be implemented and exhibits even a lower minimum axial ratio at the optimizing tuning polarization angle A equal to −20°.

Figure 23:
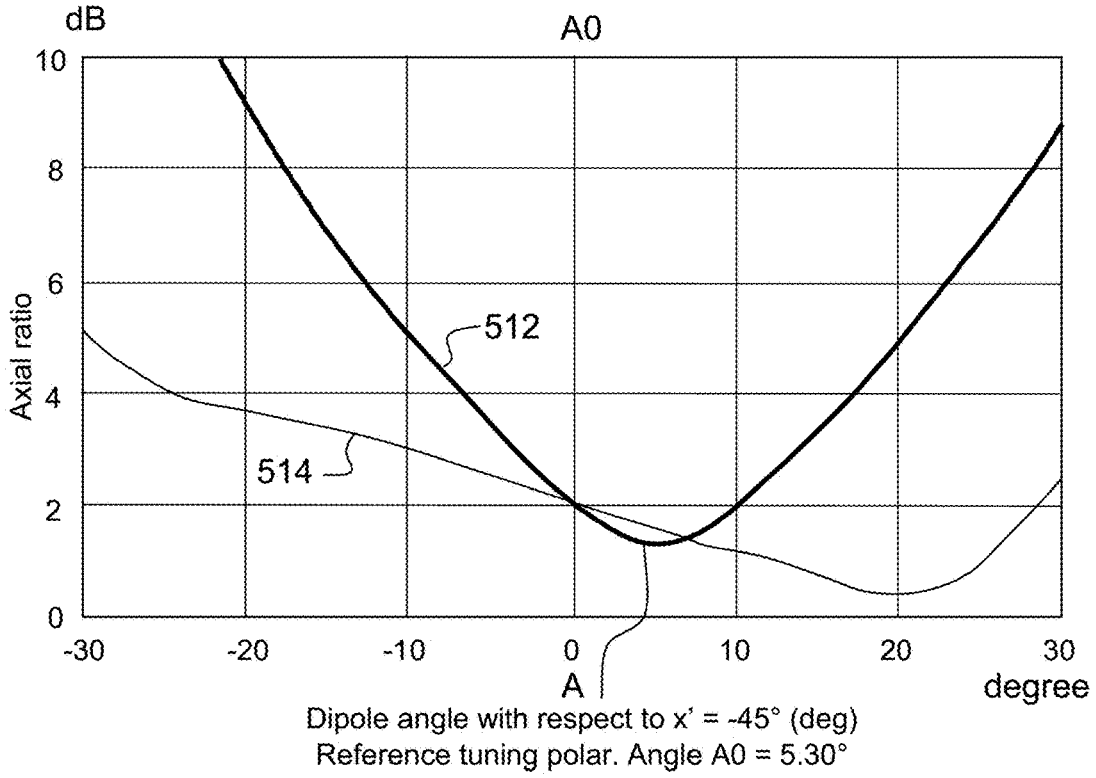
FIG. 23 is a comparative view of the evolution versus the reference tuning polarization angle A0 of the simulated axial ratio exhibited by a theoretical reference phasing cell located at a second point Q2 (y=−207.76 mm and x=+150 mm) of the curved polarizing reflector of FIG. 18 and the evolution versus the tuning polarization angle A of the simulated axial ratio exhibited by an actual phasing cell located at the same first point Q2.

As shown in the FIG. 23, a first curve 512 illustrates the simulated evolution of the axial ratio versus the reference tuning angle A0 experienced by a theoretical reference phasing cell located at the second point Q2 (y=−207.76 mm and x=+−150 mm) of the curved polarizing reflector illustrated in FIG. 18. In this theoretical configuration the respective polarization orientations of the electrical dipole and the portion of crossing metallic strip are both rotated by the same reference tuning angle A0, here equal to +5.30° according to FIG. 21. This tuning permits to keep a phasing angle between the tangential incident field Etg and the direction of elongation of the electrical dipole equal to −45°. This tuning shows a minimum of the axial ratio of the reference phasing cell equal to 1.3 dB for A0=+5.30°.

A second curve 514 is the simulated evolution of the axial ratio versus the tuning angle A experienced by an actual phasing cell located at the second point Q2 in an actual configuration. While the orientation of the portion of the crossing metallic strip is kept unchanged, only the polarization orientation of the electrical dipole is rotated by the tuning angle A in the tangent plane so that the axial ratio of the phasing cell is minimized. Here a minimum of the axial ratio equal to 0.3 dB is observed at a value of the tuning polarization angle A equal to +20 degree. When expressing A as A=k·A0, the optimizing k value is equal to 3.77.

In spite of a good axial ratio performance at the minimum of the first curve 512, in practice the physical implementation of the corresponding theoretical reference phasing cell is not feasible.

Conversely, the actual phasing cell corresponding to the second curve 514 can be physically implemented and exhibits even a lower minimum axial ratio at the optimizing tuning polarization angle A equal to 20°.

Figure 24:
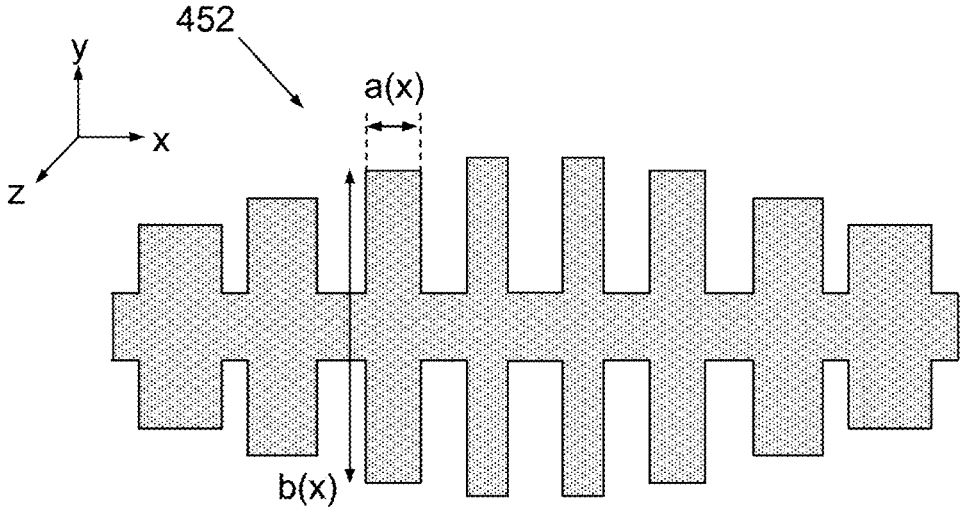
FIG. 24 is an example of a developed pattern of a row of the patches forming the patch array suited to the thin curved profile polarizing reflector of FIG. 17.

According to the FIG. 24 an example of a pattern 452 of a row of patches of a patch array layer developed along a first direction y' and the second global direction x' is illustrated.

The developed pattern shows an equal distribution in the positions of the patches along the row. The width a and the length b of the rectangular patches are respectively modulated about a central width $a_c$ and a central length $b_c$ by using a first modulating function m1(x) and a second modulating function according to the equations: $a(x)=m_1(x)\cdot a_c$ and $b(x)=m_2(x)\cdot a_c$ Such a pattern may be used for a polarizing reflector having a parabolic cylinder shape or any other surface that can be developed on a flat plane.

Generally and regardless of the various embodiments of the polarizing reflector described here above the shape of the patches 18, 228, 370, 420 is either a rectangular shape or a connected T-shape or a connected E-shape or a connected spiral E-shape.

The polarizing reflectors as described here above may be used for ground stations of fixed or mobile terrestrial networks.

The polarizing reflectors as described here above may be in particular suited to broadband satellite applications and have a thin flat or thin curved profile in order to accommodate layout requirements of a satellite during launching and in orbit.

It should be noted that the term "dielectric permittivity $\varepsilon_r$" of the dielectric substrate as used in the text here above designates in the common knowledge of the antenna designers the relative dielectric permittivity of the dielectric substrate. The relative dielectric permittivity of a material is conventionally expressed as the ratio of its "absolute" permittivity relative to the permittivity of vacuum.

The invention claimed is:

1. A polarizing reflector for broadband antennas and for converting a same linear polarization into a given circular polarization handedness over one frequency band when operating in a single wideband at normal incidence illuminated by a plane wave, or into a first given circular polarization handedness over a first frequency band and into a second handedness over a second frequency band, the first and the second circular polarization handedness being substantially equal or orthogonal when operating in dual-band at normal incidence illuminated by a plane wave, the polarizing reflector comprising a flat dielectric substrate delimited between a first surface and a second surface, having a thickness h and a dielectric permittivity $\varepsilon_r$, a patch array layer formed by a bi-dimensionally periodic lattice of thin metallic patches on the first surface of the substrate, the periodic lattice having a first set of patch rows oriented along a first direction x with a periodicity $d_x$ and a second set of patch columns oriented along a second direction y with a second periodicity $d_y$, a ground layer formed by a plain metallic layer on the second surface, located below the patch array layer;

the substrate separating the patch array layer and the ground layer, and all the patches having a same shape elongated along the second direction y and forming electric dipoles when electrically excited along the second direction y, the polarizing reflector being wherein for each row, the patches of the said row have and are all crossed by an elongated metallic strip oriented along the first direction x and having a width c, the elongated metallic strip forming one and a same integral piece, or the patches of the said row are mutually separated and all lined along the first direction x by two elongated metallic strips, each metallic strip having a width c and forming one and a same integral piece, and the geometry of the patch array, the thickness h and the dielectric permittivity $\varepsilon_r$ of the substrate, and the geometry of the elongated metallic strips are tuned so that the patch array including the elongated metallic strips induces a fundamental aperture mode and a complementary fundamental dipolar mode along two orthogonal TE and TM polarizations within the single frequency band when operating at normal incidence in a single wide band or induces a fundamental aperture mode and a first complementary fundamental dipole mode along two orthogonal TE and TM polarizations within the first frequency band and the fundamental aperture mode and a second complementary higher order dipole mode along the two orthogonal TE and TM polarizations within the second frequency band when operating in dual wide band, the differential reflection phase between the two fundamental aperture and dipole modes over the single band, or the differential reflection phase between the two fundamental aperture and dipole modes over the first frequency band and the differential reflection phase between the fundamental aperture and a higher dipole mode over the second frequency band being equal to ±90° or to an odd integer multiple of ±90°.

2. The polarizing reflector according to claim 1, wherein for each row of the patch array the patches of the said row are interconnected and crossed by a continuous elongated metallic strip oriented along the first direction x and having the width c.

3. The polarizing reflector according to claim 1, wherein the shape of the patches is either a rectangular shape or a connected T-shape or a connected E-shape or a connected spiral E-shape.

4. The polarizing reflector according to claim 1, wherein all the patches have the same shape and the same geometrical dimensions.

5. The polarizing reflector according to claim 1, wherein the size of each patch is lower than $\lambda_g/2$, preferably comprised between $\lambda_g/4$ and $\lambda_g/5$ and $\lambda_g$ designates the guided wavelength corresponding to the highest operating frequency.

6. The polarizing reflector according to claim 1, wherein the geometry of the patch array, the thickness and the dielectric permittivity of the substrate, and the geometry of the elongated metallic strips are tuned so that a first resonance frequency of the dipole mode and a first resonance frequency of the aperture mode, higher than first resonance frequency of the dipolar mode, surround the single frequency wideband of the single operating wideband or the first frequency band of the dual operating band.

7. The polarizing reflector according to claim 1, wherein the geometry of the patch array, the thickness and the dielectric permittivity of the substrate, and the geometry of the elongated metallic strips are tuned so that a first resonance frequency of the dipole mode and a first resonance frequency of the aperture mode, higher than first resonance frequency of the dipole mode, surround the single frequency wideband of the single operating wideband or the first frequency band of the dual operating band, and the first resonance frequency of the aperture mode is located before the second frequency band of the dual operating band.

8. The polarizing reflector according to the claim 1, configured for operating in dual band and wherein, the geometry of the patch array, the thickness h and the dielectric permittivity $\varepsilon_r$ of the substrate, and the geometry of the elongated metallic strips are tuned so that the differential phase between the two fundamental modes over the single or the first and second frequency bands are equal respectively to +90° and −90° or +270° or −270°.

9. The polarizing reflector according to claim 1 and suited to broadband satellite application, having a thin flat or thin curved profile.

10. The polarizing reflector for broadband antennas and for converting a same linear polarization into a given circular polarization handedness over one frequency band when operating in a single wideband at normal incidence illuminated by a plane wave, or into a first given circular polarization handedness over a first frequency band and into a second handedness over a second frequency band, the first and the second circular polarization handedness being substantially equal or orthogonal when operating in dual-band at normal incidence illuminate by a plane wave, the polarizing reflector comprising a flat dielectric substrate delimited between a first surface and a second surface, having a thickness h and a dielectric permittivity $\varepsilon_r$, and a patch array layer formed by a first bi-dimensionally periodic lattice of thin metallic patches and a second bi-dimensionally periodic lattice of thin metallic patches, both laid on the first surface of the substrate, and each of the first and second periodic lattices having a first set of patch rows oriented along a same first direction x with a same periodicity $d_x$ and a second set of patch columns oriented along a same second direction y with a same second periodicity $d_y$, and a ground layer formed by a plain metallic layer on the second surface, located below the patch array layer;

the substrate separating the patch array layer and the ground layer, all the patches having a same shape elongated along the second direction y and forming electric dipoles when excited along the second direction y, the polarizing reflector being wherein for each row of the first lattice and the second lattice, the patches of the said row have and are all crossed by an elongated metallic strip oriented along the first direction x and having a width c, the elongated metallic strip forming one and a same integral piece, and the first and the second lattices of the patches including the elongated metallic strips are geometrically interleaved while being spatially separate, and the geometry of the patch array, the thickness h and the dielectric permittivity $\varepsilon_r$ of the substrate, and the geometry of the elongated metallic strips are tuned so that the patch array induces a fundamental aperture mode and a complementary fundamental dipolar mode along two orthogonal TE and TM polarizations within the single frequency band when operating in a single wide band or induces a fundamental aperture mode and a first complementary fundamental dipole mode along two orthogonal TE and TM polarizations within the first frequency and the fundamental aperture mode and a second complementary higher order dipole mode along two orthogonal TE and TM polarizations within the second frequency band when operating in dual wide band, the differential reflection phase between the two fundamental aperture and dipole modes over the single band, or the differential reflection phase between the two fundamental aperture and dipole modes over the first frequency and the reflection differential phase between the fundamental aperture and a higher dipole mode over the second frequency band being equal to ±90° or to an odd integer multiple of ±90°.

11. A flat polarizing reflector for a broadband antenna locally illuminated at normal or oblique incidence by an electromagnetic source having a predetermined radiation pattern to the flat polarizing reflector and for converting locally a linear polarization into a given local circular polarization handedness over one frequency band when operating in a single wideband at a local normal or oblique incidence illuminated by a local plane wave originated from a predetermined source radiation pattern, or into a first local circular polarization handedness over a first frequency band and into a second local polarization handedness over a second frequency, the first and the second local circular polarization handedness being substantially equal or orthogonal when operating in dual-band at normal or oblique incidence illuminated by a local plane wave the polarizing reflector comprising a flat profile dielectric substrate, delimited between a first flat surface with a first flat profile and a second flat surface with a second flat profile, and having a thickness h and a dielectric permittivity $\varepsilon_r$, a patch array layer formed by a bi-dimensionally flat lattice of thin metallic patches on the first surface of the substrate, the flat lattice having a first set of linear patch rows and a second set of linear patch columns, a ground layer formed by a plain metallic layer on the second surface, located below the patch array layer;

the substrate separating the patch array layer and the ground layer, and all the patches having a same elongated shape and forming electric dipoles when excited along their own direction of elongation;

the polarizing reflector being wherein for each patch row, the patches of the said patch row are crossed by an elongated metallic strip having a reference width c, or the patches of the said patch row are lined by two elongated metallic strips having a reference width c, and the geometry of the patch array, the thickness h and the dielectric permittivity of the substrate, and the geometry of the elongated metallic strips being tuned so that each phasing cell, made of an elongated electric dipole and a portion of the elongated metallic strip crossing the said elongated electric dipole or made of an elongated electric dipole and a portion of the two elongated metallic strip lining the said elongated electric dipole, laid on the grounded flat substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands being equal to ±90° or to an odd integer multiple of ±90°.

12. The polarizing reflector according to claim 11, wherein for each phasing cell, while keeping unchanged the local longitudinal direction of the portion of the single crossing elongated metallic strip or the two lining elongated metallic strips, the elongated electric dipole is turned about the local normal to the first surface at the location of the phasing cell by a tuning polarization oriented angle A so that the corresponding axial ratio of the phasing cell is a minimum.

13. The polarizing reflector according to claim 12, wherein the tuning polarization oriented angle A is expressed by the equation:

$$A=k\cdot A0$$

A0 designating a reference tuning polarization oriented angle to turn only the electric dipole about the local normal so that the polarization angle $\alpha$ separating the local elongation direction of the turned electric dipole included in the local tangent plane to the first surface at the location of the phasing cell and the tangential component of the local incident electrical field in the local tangent plane is substantially equal to a same value equal to +45° or 45°, and k designating a positive real number equal or higher than 1 that depends on the level of the patch row the phasing cell belongs to and that minimizes the axial ratio of the phasing cell.

14. A curved polarizing reflector for a broadband antenna locally illuminated at normal or oblique incidence by an electromagnetic source having a predetermined radiation pattern to the curved polarizing reflector and for converting locally a linear polarization into a given local circular polarization handedness over one frequency band when operating in a single wideband at a local normal or oblique incidence illuminated by a local plane wave originated from a predetermined source radiation pattern, or into a first local circular polarization handedness over a first frequency band and into a second local polarization handedness over a second frequency band, the first and the second local circular polarization handedness being substantially equal or orthogonal when operating in dual-band at normal or oblique incidence illuminated by a local plane wave, the polarizing reflector comprising a curved profile dielectric substrate, delimited between a first curved surface with a first curved profile and a second curved surface with a second curved profile, and having a thickness h and a dielectric permittivity $\varepsilon_r$, a curved patch array layer formed by a bi-dimensionally curved lattice of thin metallic patches on the first surface of the substrate, the curved lattice having a first set of curvilinear patch rows and a second set of curvilinear patch columns, a ground layer formed by a plain metallic layer on the second surface, located below the patch array layer;

the substrate separating the patch array layer and the ground layer, and all the patches having a same substantially elongated shape and forming electric dipoles when excited along their own direction of elongation;

the polarizing reflector being wherein for each curvilinear patch row, the patches of the said curvilinear patch row are crossed by an elongated metallic strip having a reference width c, or the patches of the said curvilinear patch row are lined by two elongated metallic strips having a reference width c, and the geometry of the patch array, the thickness h and the dielectric permittivity of the substrate, and the geometry of the elongated metallic strips being tuned so that each phasing cell, made of an elongated electric dipole and a portion of the elongated metallic strip crossing the said elongated electric dipole or made of an elongated electric dipole and a portion of the two elongated metallic strips lining the said elongated electric dipole, laid on the grounded curved substrate having a permittivity $\varepsilon_r$ and a thickness h, induces locally a fundamental aperture mode and a complementary fundamental dipolar mode along two local orthogonal TE and TM polarizations within the single frequency band when operating in a single wide band or within the first frequency band and the second frequency band when operating in dual wide band, and the differential phase between the two fundamental modes over the single or the first and second frequency bands i equal to ±90° or to an odd integer multiple of ±90°.

15. The curved polarizing reflector according to claim 14, wherein the curved patch array corresponds to a virtual flat profile reference patch array formed by a bi-dimensionally reference periodic lattice of thin virtual reference metallic patches, the reference periodic lattice having a first reference set of patch rows oriented along a first reference direction x' with a periodicity $d_x$, and a second reference set of patch columns oriented along a second reference direction y' with a second periodicity $d_y$, and for each virtual reference patch row, the reference patches of the said patch row are crossed by a virtual reference elongated metallic strip generally oriented along the first reference direction x' and having a reference width c, or the reference patches of the said reference patch row are lined by two virtual reference elongated metallic strips generally oriented along the first reference direction x' and having a reference width c and to each phasing cell of the curved polarizing reflectors corresponds a virtual flat reference phasing cell made of a virtual elongated electric dipole and a portion of the virtual elongated metallic strip crossing the said virtual elongated electric dipole or made of a virtual elongated electric dipole and a portion of the two virtual elongated metallic strips lining the said virtual elongated electric dipole, laid on a virtual grounded flat substrate having a permittivity $\varepsilon_r$ and a thickness h, the elongation direction of the virtual elongated electric dipole being rotated from a predetermined angle to the second reference direction y' so that the said dephasing cell of the curved polarizing reflector induces locally a fundamental aperture mode and a complementary fundamental dipolar mode along two local orthogonal TE and TM polarizations within the single frequency band when operating in a single wide band or within the first frequency band and the second frequency band when operating in dual wide band, the differential phase between the two fundamental modes over the single or the first and second frequency bands being equal to ±90° or to an odd integer multiple of ±90°.

16. The curved polarizing reflector according to claim 15, wherein the curved patch array is a projection of the virtual flat profile reference patch array generally located closest to the first surface of the substrate.

17. The curved polarizing reflector according 15, wherein the first curved surface is a portion of a circular cylinder or a parabolic cylinder or an elliptic cylinder or a hyperbolic cylinder, and the virtual flat profile reference path array is the curved patch array developed on a flat surface.

18. The curved profile polarizing reflector according to claim 14, wherein the virtual flat reference patch rows are sets of rectangular patches regularly spaced, the width and the length of the patches being modulated according to the direction of the rows, and/or the shape of the patches is either a rectangular shape or a connected T-shape or a connected E-shape or a connected spiral E-shape.

* * * * *